US007637048B2

(12) United States Patent
Tal et al.

(10) Patent No.: US 7,637,048 B2
(45) Date of Patent: Dec. 29, 2009

(54) UNIVERSAL PISTOL MAGAZINE LOADER

(76) Inventors: Guy Tal, P.O. Box 302, Rosh Ha'ayin (IL) 48103; Ran Tal, P.O. Box 302, Tel Aviv (IL) 48103

( * ) Notice: Subject to any disclaimer, the term of this patent is extended or adjusted under 35 U.S.C. 154(b) by 72 days.

(21) Appl. No.: 11/886,144

(22) PCT Filed: Apr. 20, 2006

(86) PCT No.: PCT/IL2006/000477

§ 371 (c)(1),
(2), (4) Date: Sep. 12, 2007

(87) PCT Pub. No.: WO2006/109315

PCT Pub. Date: Oct. 19, 2006

(65) Prior Publication Data

US 2008/0184608 A1 Aug. 7, 2008

Related U.S. Application Data

(60) Provisional application No. 60/671,400, filed on Apr. 15, 2005.

(51) Int. Cl.
*F41A 9/66* (2006.01)
*F41A 9/67* (2006.01)

(52) U.S. Cl. ..... 42/87

(58) Field of Classification Search ..... 42/87, 42/88, 90

See application file for complete search history.

(56) References Cited

U.S. PATENT DOCUMENTS 2,466,017 A 4/1949 Farber (Continued)

FOREIGN PATENT DOCUMENTS

DE 304379 2/1921

(Continued)

OTHER PUBLICATIONS www.CommandArms.com and www.tdi-arms.com products: MLU556, MLU762, ML556 MLU16, MLU47.

(Continued)

*Primary Examiner*—Bret Hayes
(74) *Attorney, Agent, or Firm*—David Pressman

(57) ABSTRACT

A firearm magazine loader (30) comprises a body (32) coupled to a movable press (40), a plunger (20) extending out of the press towards the body, and a magazine aligner (52). The body is hollow and adapted to fit and slide over an open side of a magazine (10). A spring (48) is positioned between the body and the press to force them apart. To load the magazine, the user squeezes the press towards the body such that plunger is over a topmost round (12) in the magazine, and then presses down the loader, causing the plunger to force the topmost round further into the magazine to form a vacant space below lips (14) of the magazine. This enables a new round (13) to be rearwardly, case first, loaded inside the vacant space. The user then eases the down force on the loader allowing the spring (16) of the magazine to force up all the rounds in the magazine towards the lips while releasing the press for allowing the spring of the press to force the press and plunger back to their original position. The magazine aligner is positioned inside the body for centering the open side of magazines of different widths and depth mounted in the loader in line with the plunger.

38 Claims, 10 Drawing Sheets

U.S. PATENT DOCUMENTS

| | | | | | |
|---|---|---|---|---|---|
| 4,304,062 | A | | 12/1981 | Pepe | |
| 4,464,855 | A | | 8/1984 | Musgrave | |
| 4,570,371 | A | * | 2/1986 | Mears | 42/90 |
| 4,574,511 | A | * | 3/1986 | Csongor | 42/87 |
| 4,689,909 | A | * | 9/1987 | Howard | 42/87 |
| 4,719,715 | A | * | 1/1988 | Howard | 42/87 |
| 4,720,931 | A | * | 1/1988 | Jensen | 42/87 |
| 4,827,651 | A | * | 5/1989 | Conkey | 42/87 |
| 4,829,693 | A | * | 5/1989 | Holmes | 42/87 |
| 4,872,279 | A | | 10/1989 | Boat | |
| 4,888,902 | A | * | 12/1989 | Knowles | 42/90 |
| 4,939,862 | A | | 7/1990 | Brandenburg | |
| 4,949,495 | A | | 8/1990 | Mari | |
| 4,993,180 | A | * | 2/1991 | Upchurch | 42/87 |
| 5,249,386 | A | * | 10/1993 | Switzer | 42/87 |
| 5,301,449 | A | | 4/1994 | Jackson | |
| 5,355,606 | A | * | 10/1994 | Origoni | 42/87 |
| 5,377,436 | A | * | 1/1995 | Switzer | 42/87 |
| 5,402,594 | A | | 4/1995 | Switzer | |
| 5,417,003 | A | | 5/1995 | Claveau | |
| 6,154,997 | A | * | 12/2000 | Aluotto et al. | 42/90 |
| 6,178,683 | B1 | * | 1/2001 | Williams | 42/90 |
| 6,189,254 | B1 | | 2/2001 | Steitz | |
| 6,219,953 | B1 | | 4/2001 | Bently | |
| 6,286,243 | B1 | * | 9/2001 | Hinton | 42/87 |
| D477,047 | S | | 7/2003 | Springer | |
| 6,678,985 | B2 | | 1/2004 | Pikula | |
| 6,810,616 | B2 | * | 11/2004 | Tal et al. | 42/87 |
| 6,817,134 | B2 | * | 11/2004 | Newman | 42/87 |
| 7,503,138 | B2 | * | 3/2009 | Tal et al. | 42/87 |
| 2004/0020096 | A1 | * | 2/2004 | Tal et al. | 42/87 |
| 2004/0159035 | A1 | * | 8/2004 | Newman | 42/87 |
| 2004/0159036 | A1 | * | 8/2004 | Newman | 42/87 |
| 2007/0017140 | A1 | * | 1/2007 | Pikielny | 42/87 |
| 2007/0107291 | A1 | * | 5/2007 | Tal et al. | 42/87 |

FOREIGN PATENT DOCUMENTS

| | | |
|---|---|---|
| FR | 693501 | 11/1930 |
| GB | 552171 | 3/1943 |
| GB | 555367 | 8/1943 |

OTHER PUBLICATIONS www.adcosales.com "Super Tumb" family of loaders www.midwayusa.com www.impactguns.com.

* cited by examiner

UNIVERSAL PISTOL MAGAZINE LOADER

CROSS-REFERENCE TO RELATED APPLICATIONS

This application claims the benefit of U.S. Provisional Patent Application Ser. No. 60/671,400 filed Apr. 15, 2005, and U.S. Provisional Patent Application Ser. No. 60/736,005, filed Nov. 14, 2005.

The invention relates to firearms, particularly to a method and accessory for facilitating loading of firearm rounds into a firearm magazine.

PRIOR ART

Many small firearms, including pistols, assault rifles, and submachine guns, utilize and fire rounds (also known as cartridges and ammunition). Each round is substantially elongated and comprises a deep cuplike case (also known as a shell casing and sometimes also a cartridge), usually of brass, which is filled with an explosive propellant. At its rear or closed end, the case has a rim or flange containing a primer; the front and opposite end of the case is open. A bullet, slug, or head, usually of lead (optionally jacketed) is partially inserted into the open or front end of the case by crimping the case onto the bullet.

The rounds are held within and fed into the firearm from a magazine (also known as a clip). A detachable magazine has become dominant throughout the world. The term 'magazine' is broad, encompassing several geometric variations, including curved magazines. Most detachable magazines are similar, varying in form and structure, rather than in their general principles of operation.

Magazines usually take the form of an elongated container having a generally rectangular cross-section, which is attached to the underside of the firearm. Magazines are commonly made of aluminum alloys, plastic, steel, or a combination. They are usually closed on five sides and open on a sixth, upwardly facing, top, side, or end, and are substantially hollow. The top or open side has a rectangular end and includes two round-retaining members, known as feed lips. Magazines have an internal spring which urges a follower or pusher (blank shaped piece of plastic or metal) toward the open side. The follower in turn urges the rounds as a group up against the lips. The lips act as a stop for the rounds so that they are not expelled from the magazine.

Rounds are stacked or oriented in the magazine such that the longitudinal axes of the rounds are substantially parallel and perpendicular to the direction of travel of the spring and follower. Adjoining rounds are oriented side-by-side, i.e., the bullets of adjacent rounds are next to each other, as are the cases.

The rounds are usually stacked in the magazine, either in a single straight column or in a staggered, zigzag, column (also called double-stacked or high-capacity) fashion. The latter magazines, being wider, achieve higher round capacity compared to single-column magazines of the same overall length.

Commonly, in pistol magazines and in some submachine gun magazines, whether staggered or not, the space between the retaining lips is smaller than the case diameter of the rounds so that the two lips of the magazine hold the topmost round. Magazines of most assault rifles and submachine guns contain staggered rounds, and in contrast to the above pistol magazines, the topmost round is held in place by only a single lip. The latter magazines are not relevant here, so hereafter the term 'magazine' will mean magazines where two lips retain the topmost round.

Prior to use, a firearm magazine must be loaded (charged or filled). When a magazine is being loaded, it is necessary to depress all previously loaded rounds to provide space below the lips so an additional round can be loaded inside. Each time another round is loaded the spring is further compressed, requiring more insertion force. When a magazine is fully loaded, the spring is fully compressed and exerts maximum upward force against the follower and rounds towards the lips.

Loading magazines is relatively time-consuming, tedious, and painful practice if done with bare fingers. Pain accumulates and intensifies as more rounds are loaded against the increasing spring pressure, therefore slowing the loading process. When a plurality of magazines are to be loaded, much time is required, shortening reposing, training, or combat time. In combat circumstances, slow reloading can be life-threatening.

Straightforward bare finger loading is usually done with the user placing a new round on top of the front end of the case of the topmost round in the magazine, or on the bullet. Then the user uses the thumb to force down the new round, and hence all round(s) below it, into the magazine sufficiently to make space below the lips to slide the new round backwards below the lips to be retained by them.

To increase loading speed and decrease finger pain, numerous attempts have been made to provide adequate pistol magazine loaders. These include several types:

A. Portable and non-portable loaders that are operated as machines and are not held by hand. These are shown in the following patents:
   a. Great Britain patent 552,171 to Andree, Mar. 25, 1943;
   b. U.S. Pat. No. 4,949,495 to Mari, Aug. 21, 1990;
   c. U.S. Pat. No. 4,939,862 to Brandenburg et al., Jul. 10, 1990.

Such machines employ the loading method and technique of group 'B' below.

B. Handheld loaders which use a substantially thick plunger or pusher which is usually perpendicular to the case of the topmost round. The plunger presses down the topmost round so that a new round can be inserted from the front of the magazine until the case of the round engages the plunger, approximately a half-length below the lips. Then the plunger is raised up and the new round is pressed with a finger further backwards into its place below the lips. These loaders are shown in the following patents:
   a. Great Britain patent 555,367 to Davis et. al., Aug. 19, 1943;
   b. German patent 304379 to Mauser, Feb. 15, 1921;
   c. French patent 693,501 to Seytres, November, 1930;
   d. U.S. Pat. No. 2,466,017 to Farber, Apr. 5, 1949;
   e. U.S. Pat. No. 4,570,371 to Mears, Feb. 18, 1986;
   f. U.S. Pat. No. 4,689,909 to Howard, Sep. 1, 1987;
   g. U.S. Pat. No. 4,719,715 to Howard, Jan. 19, 1988;
   h. U.S. Pat. No. 4,827,651 to Conkey, May 9, 1989;
   i. U.S. Pat. No. 4,829,693 to Holmes, May 16, 1989;
   j. U.S. Pat. No. 4,888,902 to Knowles, Dec. 26, 1989;
   k. U.S. Pat. No. 4,993,180 to Upchurch, Feb. 19, 1991;
   l. U.S. Pat. No. 5,377,436 to Switzer, Jan. 3, 1995;
   m. U.S. Pat. No. 6,189,254 to Steitz, Feb. 20, 2001;
   n. U.S. Pat. No. 6,286,243 to Hinton, Sep. 11, 2001;
   o. U.S. Pat. No. 6,817,134 to Newman, Nov. 16, 2004;
   p. U.S. Pat. No. 6,178,683 to Williams, Jan. 30, 2001;
   q. U.S. Pat. No. 6,219,953 to Bently, Apr. 24, 2001;
   r. US patent D477,047 to Springer, Jul. 8, 2003.

Such loaders do not relieve the user from manually pushing the newly inserted round rearwardly against the spring pressure, all the way back into place below the lips. This is commonly done with the thumb against the tip of the bullet. While these are the most common loaders available in the market, they are of limited value as the fingers still accumulate pain when pushing the rounds in, and are limited in the range of magazines each can load.

C. Handheld loaders which are limited to load a relatively small group of magazines having an exposed follower and spring by directly compressing the spring first, and then loading rounds in the magazine. These loaders are shown in the following patents:
   a. U.S. Pat. No. 5,402,594 to Switzer, Apr. 4, 1995;
   b. U.S. Pat. No. 4,872,279 to Boat, Oct. 10, 1989.

D. A round loading tray by which rounds are first laid on the tray and the magazine is manipulated from above to load each round in. These include:
   a. U.S. Pat. No. 4,304,062 to Pepe et al., Dec. 8, 1981;
   b. U.S. Pat. No. 6,678,985 to Pikula, Jan. 20, 2004.
   Such loaders are slow to use since time is spent laying the rounds into place and they require much practice to load the rounds.

E. 'Semi-automatic' loaders for loading rim-fire rounds, i.e., usually 0.22 caliber rounds which have extended rims at the back end of the case. Such a loader is shown in U.S. Pat. No. 5,301,449 to Jackson, Apr. 12, 1994. These loaders are good for limited types of magazines and rounds.

F. Handheld loaders that generally access the topmost round from the front of the magazine, rather than from above, using a planar guide. These include:
   a. U.S. Pat. No. 4,464,855 to Musgrave, Aug. 14, 1984. Musgrave shows a Z-shaped detachable loader that must be detached entirely from the magazine after each round is loaded and reinstalled back for the next round to be loaded. While it may facilitate loading, the necessity of attachment, sliding a new round in, and detachment makes its use inefficient, tedious, and awkward. It further lacks a structure which is comfortable for repeated use against the magazine's spring pressure, and is generally flimsy and delicate to use under field conditions. Further, it is not efficient to load magazines having rounded front walls as it has a flat base which causes a tray to be misaligned with the topmost round, causing the tray to usually engage a lip of the magazine. The loader thus is jammed and disrupts the loading process.
   b. U.S. Pat. No. 5,417,003 to Claveau, May 23, 1995. Claveau describes a planar loader that relies almost entirely on the thumb to press down the topmost round, against the magazine's spring pressure, to load a new round. Further, while pressing down the topmost round, the thumb has to slide the new round in underneath the lips, as seen in its FIGS. 7-9. This pressure on the thumb makes this loader painful and uncomfortable for repeated use.

A limited group of loaders exist that have a plunger designed specifically for rifle and submachine gun magazines; these usually have a single lip holding the topmost round rather than two lips holding the topmost round as most pistol magazines. These include:

a. U.S. Pat. No. 6,810,616 to Tal et. al., Nov. 2, 2004, describes a loader and unloader accessory which use two plungers to push down a topmost round or a second-to-topmost round. Although it pushes a topmost round using a hinged lever, it does not allow sufficient vacant space immediately above that round as the pressing plunger blocks the space required for loading a pistol magazine (but not a rifle magazine). Nevertheless, this loader is extremely popular among rifle and submachine gun users, and is well built.
   b. Command Arms Accessories and First Samco sell loaders with model numbers MLU556 and MLU762. These are shown at www.commandarms.com and or www.tdi-arms.com. Again, these use two plungers to push down a topmost round or a second-to-topmost round. Once more, a plunger pushes a topmost round using a hinged lever not allowing sufficient vacant space immediately above that round as the plunger blocks the space required for loading a pistol magazine. This loader is uncomfortable and relatively slow to use, and comprise relatively many parts.

Again, in the market there are many different pistol magazines. They differ in their round capacity, round caliber, manufacturing materials and technique, adaptability to match magazine wells of different pistols, shape of lips, and magazine lock mechanism. Often, each pistol and matching caliber has its own unique magazine. Therefore, to overcome the extremely wide range of magazines with all their mechanical variations, manufacturers of magazine loaders had to manufacture:

1. loaders of different sizes, such as the Super Thumb family of loaders from ADCO Sales Inc., shown at www.adcosales.com (ADCO has four different loader sizes), or loaders from Glock Inc.;
2. loaders with an integral adjustable mechanism, such as the HKS loaders (U.S. Pat. Nos. 5,249,386 and 5,377,436 to Switzer, Oct. 5, 1993 and Jan. 3, 1995 respectively), having both different overall sizes and also a magazine length adjuster in each (HKS has ten different loader sizes in the market); or
3. loaders with an external adjustable means, such as the Cambi loader model #104 shown at www.worldwideordnance.com (U.S. Pat. No. 6,817,134 to Newman Nov. 16, 2004) having four separate insertable "spacers" to cater for different magazine widths.

In summary, bare finger pistol magazine loading is tedious, cumbersome, and injurious. While several accessories have been provided for facilitating this chore, none are able to load loose rounds into a magazine efficiently, rapidly, safely, easily, and painlessly. Further, while there have been attempts to provide a mechanism for accepting large range of different pistol magazines in a single magazine loader, none was able to do just that, and all are quite limited in the range of magazine they accept. Further, all existing 'adjustable' loaders have to be adjusted prior to use, and none has an automatic adjusting means.

ADVANTAGES

Accordingly, several advantages of one or more aspects are to provide (a) a method and mechanism for automatically allowing a wide range of different magazines to be loaded with a single magazine loader for facilitating loading of loose rounds into a magazine quickly and easily, (b) a loader which is workable at relatively high speed with minimal fatigue to a user's fingers, and where no force will be exerted on a single finger, (c) a durable loader that is simple to operate in tough, varying, military conditions, and (d) a low-cost, pocket-size, lightweight loader comprising few parts. Further advantages of one or more aspects will become apparent from a consideration of the drawings and ensuing description.

SUMMARY

An accessory and method for facilitating loading loose rounds into a firearm magazine basically comprises, in one aspect, four parts: a body adapted to slidably fit over an open side of a magazine, a movable press, an integral beak-like plunger on the press, and a magazine aligner. The press is hinged to the body and a spring member is fitted between to keep them angled apart. The plunger is flat and shaped to fit between the lips of the magazine. For loading, the loader is initially fitted on the magazine and the magazine's bottom is placed on a support. The press is then squeezed in to bring the plunger directly above the topmost round of the magazine, when partially loaded. While squeezed, the user forces the loader down along the magazine to cause the plunger to push the topmost round further into the magazine. A vacant space is then formed below the lips of the magazine and above the plunger. The user then drops a new round rearwardly into the vacant space. The new round free falls into place without being pushed in by the thumb or stopped by the plunger. Then the user eases the downward force on the loader to enable all the rounds in the magazine to be forced up by the spring of the magazine while substantially simultaneously releasing the squeeze on the press to retract the plunger outward from below the newly loaded round.

Hence, magazine loading is done by cycling the loader on the magazine as described with one hand while synchronously feeding rounds into the magazine with the other hand. Further, the magazine aligner, preferably included with at least one version of the loader, allows different magazines to be loaded without any user intervention or prior adjustments. This makes this loader a substantially universal magazine loader (trademarked "UpLULA").

The aligner basically comprises a single part: an inverted "V" shaped body hingely coupled to the body of the loader. The aligner forces the top of the magazine to center in the loader directly in front or below the plunger. A spring member is fitted between the body of the loader and the aligner to keep the aligner in tension over the magazine.

DRAWING FIGURES

FIG. 5B shows a front view, FIG. 5C shows a top view, and FIG. 5D shows a side view.

DRAWING REFERENCE NUMERALS

| | | | |
|---|---|---|---|
| 10 | double-stack magazine | 12 | round |
| 13 | new round | 14 | lip of double-stack magazine |
| 16 | spring of magazine | 18 | follower |
| 20 | plunger | 20A | simplified plunger |
| 22 | concave recess | 24 | base of plunger |
| 30 | loader | 32 | body |
| 34 | stop rib | 36 | press arm |
| 37 | aligner arm | 38 | bridge |
| 40 | press | 40A | simplified press |
| 42 | press side wall | 44 | side wall recess |
| 46 | press retainer | 47 | press pin |
| 48 | press spring | 50 | press hinge |
| 52 | aligner | 54 | aligner hinge |
| 56 | aligner pin | 58 | aligner spring |
| 59 | aligner wing | 60 | hand |
| 90 | center line | 100 | single stack magazine |
| 114 | lips of single stack magazine | 200 | first alternative plunger |
| 200A | second alternative plunger | 300 | first alternative loader |
| 300A | second alternative loader | 300B | third alternative loader |
| 300C | forth alternative loader | 300D | fifth alternative loader |
| 300E | sixth alternative loader | 300F | seventh alternative loader |
| 320 | first alternative body | 320A | second alternative body |
| 320B | third alternative body | 325 | slide opening |
| 330 | body stop protrusion | 360 | alternative press arm |
| 360A | alternative press arm | 380 | alternative bridge |
| 400 | first alternative press | 400A | second alternative press |
| 400B | third alternative press | 400C | forth alternative press |
| 400D | fifth alternative press | 400E | sixth alternative press |

-continued

| | | | |
|---|---|---|---|
| 400F | seventh alternative press | 410 | ear |
| 410A | alternative ear | 420 | side wall of first alternative press |
| 425 | slide protrusion | 430 | press stop protrusion |
| 460 | alternative press retainer | 480 | alternative press spring |
| 480A | alternative press spring | 490 | arm |
| 492 | arm | 494 | boss |
| 496 | headed pin | 497 | thumb |
| 498 | lever | 499 | thumb cover |
| 500 | alternative press hinge | 500A | alternative press hinge |
| 520 | alternative aligner | 580 | alternative aligner spring |
| 585 | alternative aligner spring | 590 | alternative aligner wings |
| 595 | alternative aligner | | |

DETAILED DESCRIPTION—PREFERRED EMBODIMENT

FIGS. 1A-1F—Simplified Diagrams

FIG. 1A to 1F are simplified side sectional schematic diagrams illustrating the hardware and loading method.

Figure 1A:
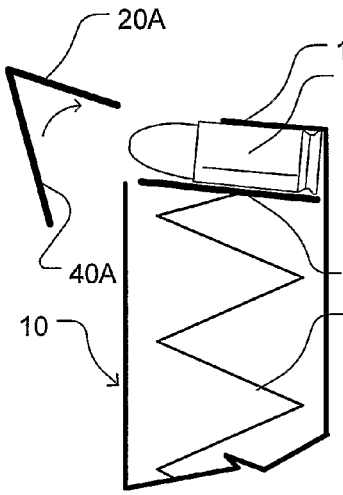
FIGS. 1A to 1F are simplified diagrams showing (1A) a plunger in front and distant of a topmost round in a magazine, the plunger close and above a portion of the topmost round (1B), the plunger pressing down the topmost round (1C), a new round loaded (1D) into the magazine, the rounds raised up inside the magazine (1E), and the plunger released back from the magazine (1F).

FIG. 1A shows a magazine 10 loaded with a topmost round 12 retained by a lip 14 of the magazine and pushed up against the lip by a follower 18 which is in turn urged up by a spring 16 of the magazine. A simplified plunger or pusher 20A is also shown at a first 'away' position in front or to the left and relatively distant from the open side of magazine 10 and round 12. The plunger is rigid and thin and has a free end or edge, shown connected to a simplified press 40A.

Figure 1B:
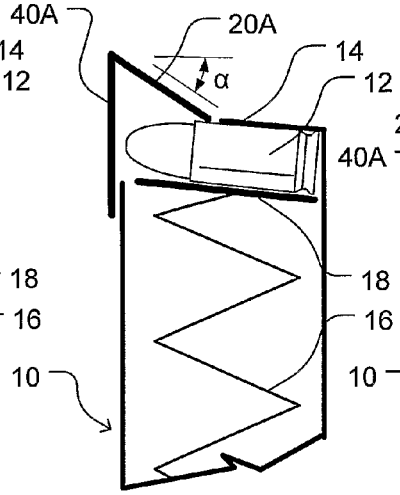

FIG. 1B shows a second or 'close' position of the plunger, moved over the magazine and partially above topmost round 12 with its right (front) edge over the left side of the case. The plunger has a downward angle $\alpha$ with the horizontal.

Figure 1C:
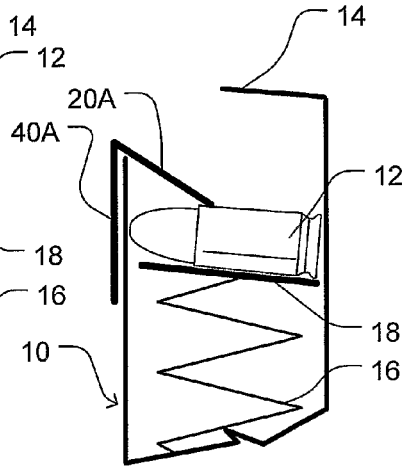

FIG. 1C shows the plunger down in the magazine pressing or forcing the topmost round further inside the magazine and thereby forming a vacant space (not numbered) below lip 14.

Figure 1D:
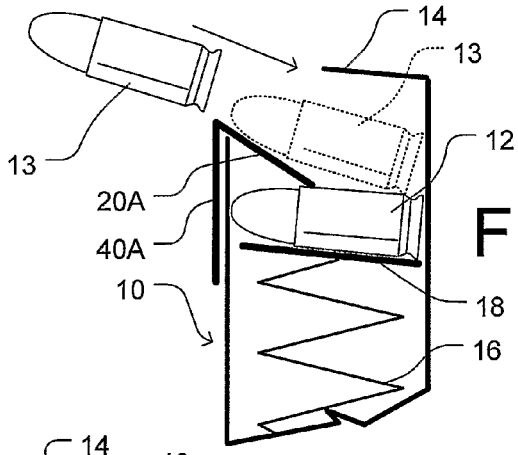

FIG. 1D shows a new round 13 rearwardly loaded, i.e., case first, into the magazine, in the general direction of the arrow. The new round is inserted in the vacant space below lip 14 and above plunger 20A as shown in broken lines. Note that nothing blocks the new round from entering the vacant space and it is entirely in the magazine.

Figure 1E:
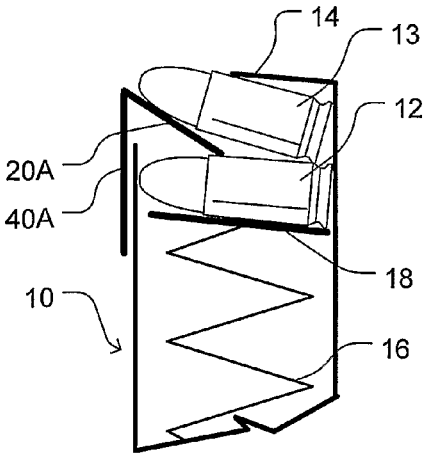

FIG. 1E shows the two rounds and plunger raised up slightly by the magazine's spring force and the new topmost round 13 engaging the underside of lip 14.

Figure 1F:
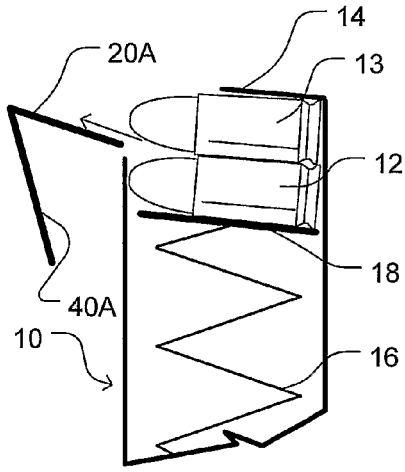

FIG. 1F shows the plunger retracted back (to the left) in a substantially linear path, as shown by the arrow, from between top round 13 and round 12, which now is the second round down.

Note that plunger 20A has two basic positions relative to the topmost round and the open side of the magazine: an 'away' position where the plunger is relatively distant or farther from the topmost round in the magazine or the open side of the magazine (FIGS. 1A and 1F), when the magazine is installed in the loader, and a 'close' position where the plunger is relatively closer or above a topmost round in the magazine or the open side of the magazine (primarily FIG. 1B), when the magazine is installed in the loader.

Figure 2A:
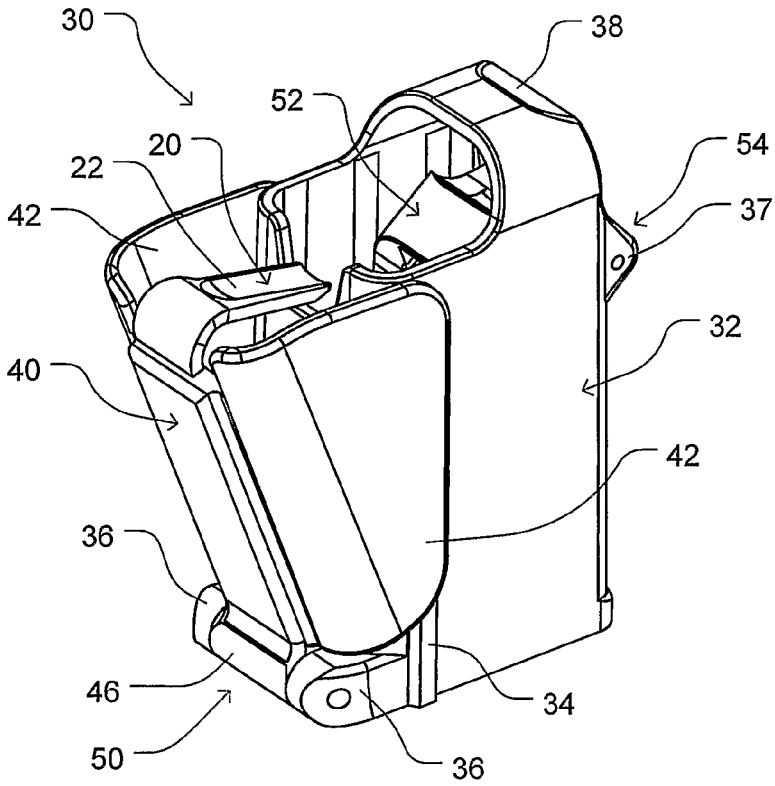
FIG. 2A is a perspective view of a new universal magazine loader shown in an 'away' position.
Figure 2B:
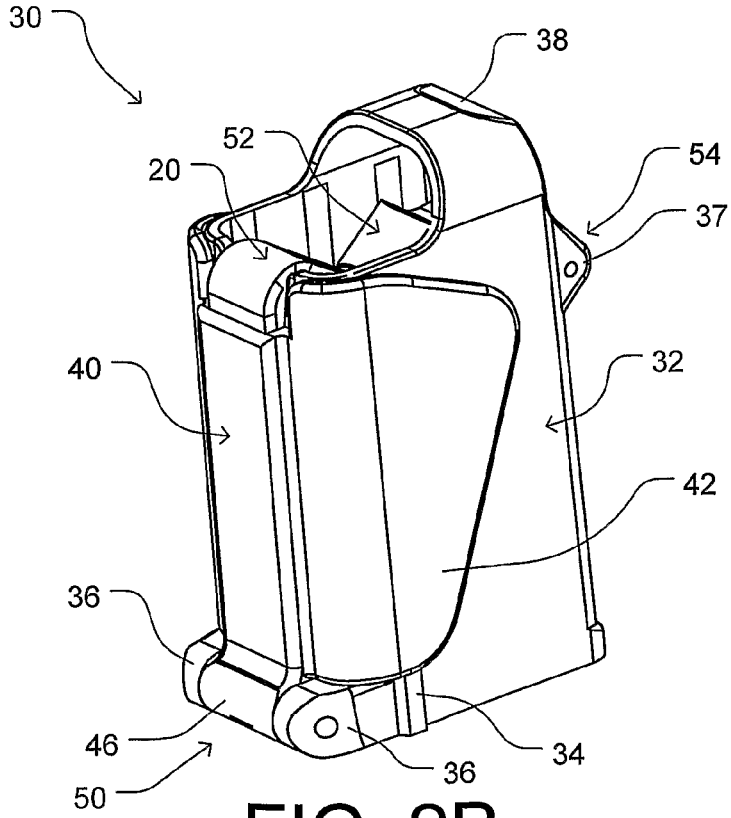
FIG. 2B is a perspective view of the loader shown in a 'close' position.

FIGS. 2A-2B—Perspective Views

FIG. 2A is a perspective view of a preferred embodiment of an actual magazine loader 30, with a plunger 20 shown in the 'away' position. Loader 30 preferably comprises four main parts: a substantially rectangular elongated hollow body or housing 32 having four connecting sidewalls, a hand press 40, the plunger or pusher 20 which is analogous to simplified plunger or pusher 20A of FIGS. 1A-1F and is integral with and extends from the top of press 40, and a magazine aligner 52.

The bottom of the press is coupled by a hinge 50 to the body. Main body 32 includes an open bottom end (not shown), a top open end partially covered by a bridge 38, two parallel and opposite sidewalls, and front and opposite back walls (not numbered). On the bottom of each side wall is a vertical stop rib 34. Two spaced and parallel press arms 36 extend out of the bottom of the front wall of the main body. Each arm includes a through hole (not numbered). These holes hold a pin (47, FIG. 3A) of hinge 50. The bridge extends between and joining the two sidewalls of the body.

Press 40 has two sidewalls 42 interconnected by a front wall (not numbered). Sidewalls 42 are parallel to the sidewalls of the main body. The front wall of the press has a retainer 46 at its bottom. The retainer is part of hinge 50, and pin 47 (FIG. 3B) passes through it. At the 'away' position the front wall of the press is angled approximately 21 degrees from the vertical or the left wall (not numbered) of the main body.

Figure 3A:
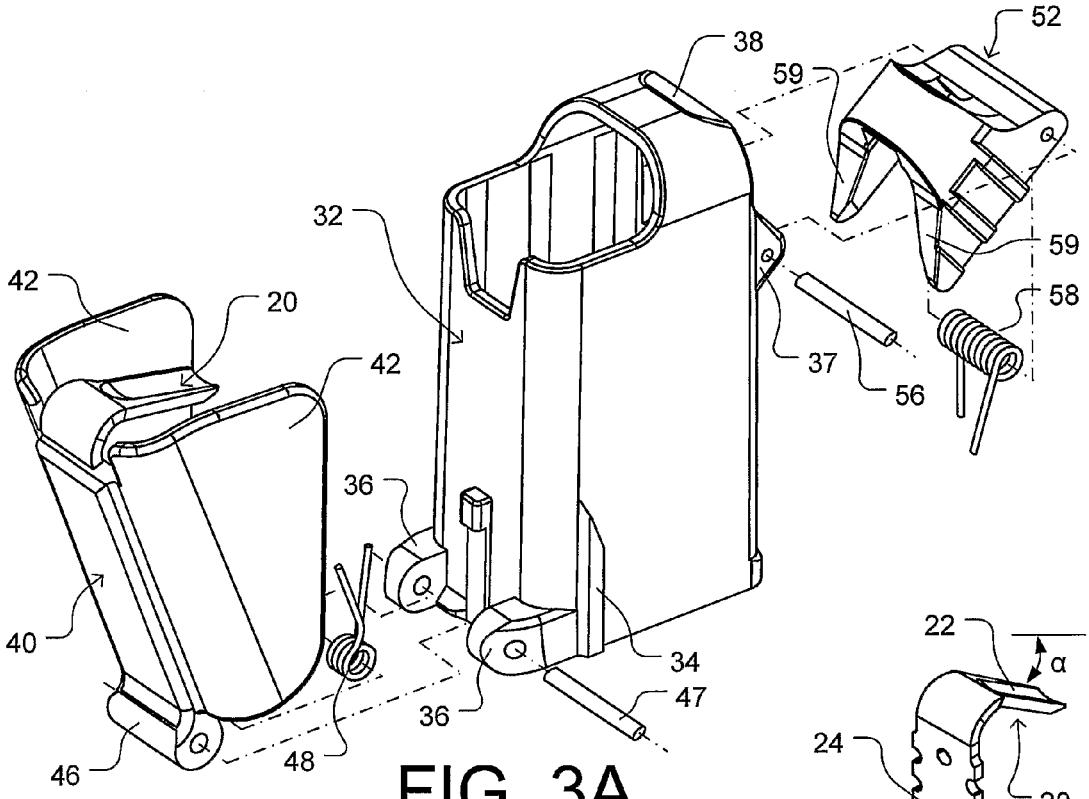
FIG. 3A is a front exploded view of the loader.
Figure 3C:
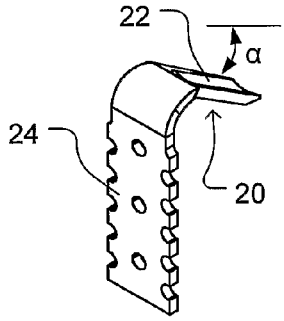
FIG. 3C is a perspective view of a plunger.

Plunger 20 is made of a substantially flat or planar piece of hardened steel, preferably between 6 mm to 8 mm in width at its exposed distal (right) and free edge or end, and approximately 2 mm in thickness (see FIG. 3C). It is shown extending and angling down from the upper end of press 40 towards the main body. Plunger 20 and press 40 together constitute an inserting member. The plunger preferably has a smooth elongated concave recess 22 at its upper surface extending central to its distal edge. It is further rounded at the underside of its distal edge (not shown) to avoid denting the case of a topmost round in the magazine under loading pressure. The width of the plunger is chosen to enable it to enter between the lips of relatively thin or narrow magazines carrying preferably .380 caliber rounds. This width is usually acceptable for loading magazines carrying up to .45 caliber rounds. Such range of calibers, from preferably .380 to .45 (commonly .380, 9 mm, 10 mm, .40, and .45 calibers) is found to cover a large portion of the market. Not all .380 magazines may be loaded with plungers of this width, but some can.

FIG. 2A also shows magazine aligner 52 positioned inside and at the upper rear part of main body 32 below bridge 38. The aligner is hinged to the body by an aligner hinge 54, and is shown pointing down. The aligner will be described in more detail below.

The main body, press, and aligner of the loader are designed for low-cost mass-production plastic injection molding. The preferred plastic material is glass-fiber reinforced polyamide (nylon), which is durable and substantially resistant to gun oil and other chemicals. Other materials may be used for construction. The weight of the loader is approximately 50 grams, and sized to fit in a pocket.

FIG. 2B is a perspective view of loader 30, where the plunger is shown in a 'close' position. In the 'close' position, press 40 with its sidewalls 42 engages main body 32 completely and plunger 20 is angled $\alpha$ degrees down from the horizontal inside the main body.

Figure 3B:
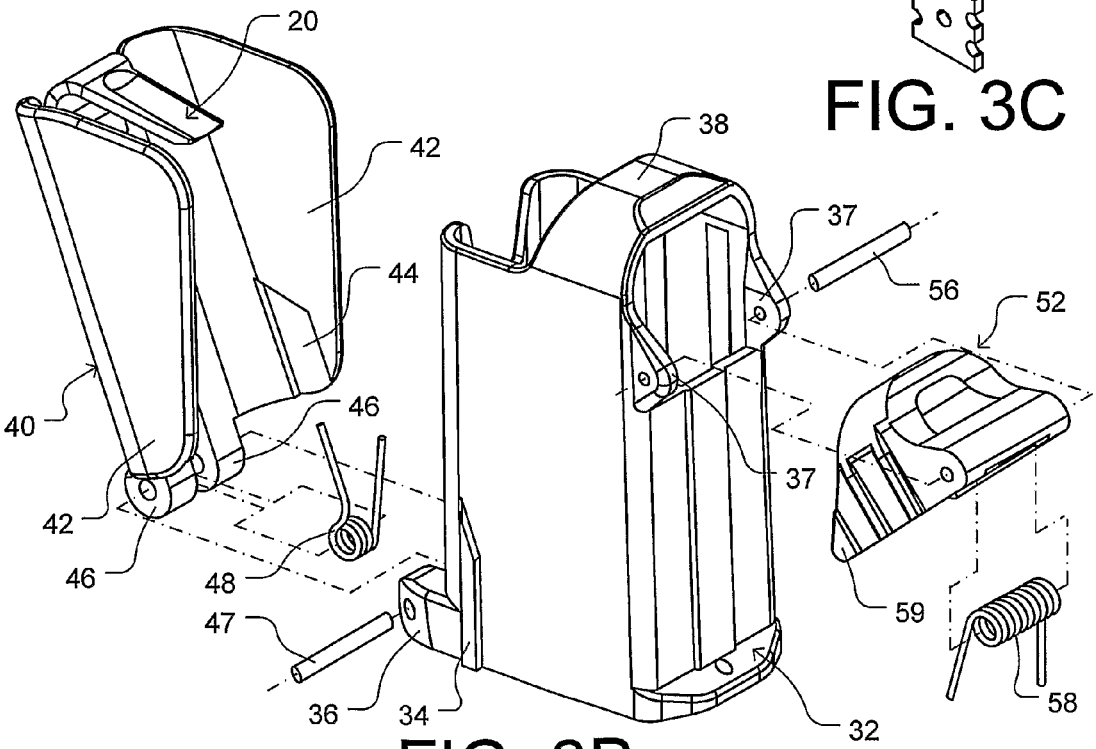
FIG. 3B is a rear exploded view of the loader.

FIGS. 3A-3C—Exploded View

FIG. 3A is a front exploded view of loader 30 showing press 40 with its side walls 42, plunger 20, and retainer 46 which contains a through hole (not numbered). Pin 47 couples together the main body and press and which is inserted through holes (not numbered) in arms 36 of the main body and retainer 46. A press torsion spring 48 is encompassed by retainer 46 and is secured by pin 47. The two arms of spring 48 are positioned between the press and the main body and are initially spaced such to urge the press to rotate out or away from the main body to the 'away' position.

Magazine aligner 52 is coupled to the main body by an aligner pin 56 which is fixed through holes (not numbered) in an upper aligner arms 37 of the main body and through side holes (not numbered) at the rear of aligner 52. An aligner torsion spring 58 is positioned at the rear of the aligner and is also retained by pin 56. The two arms of spring 58 are positioned one on the aligner and one on the body to exert force to angle the aligner down inside the body. The aligner has two elongated wings 59.

Two projection lines show how all the parts assemble together.

FIG. 3B is a rear exploded view of the loader with an internal view of side walls 42. Each side wall includes a recess 44, 1.5 to 2.5 mm deep, sized to cover and engage a top portion of stop rib 34 of the main body. Rib 34 then acts as to stop press 40 at its 'away' angle to approximately 21 degrees as mentioned above.

FIG. 3C is a perspective rear view of plunger 20. Plunger 20 has a base 24. The press preferably is molded over base 24 to secure the plunger tightly to the press. Base 24 preferably has holes and grooves (not numbered) so that the injected polymer will be able to flow in for a solid grip.

Figure 4A:
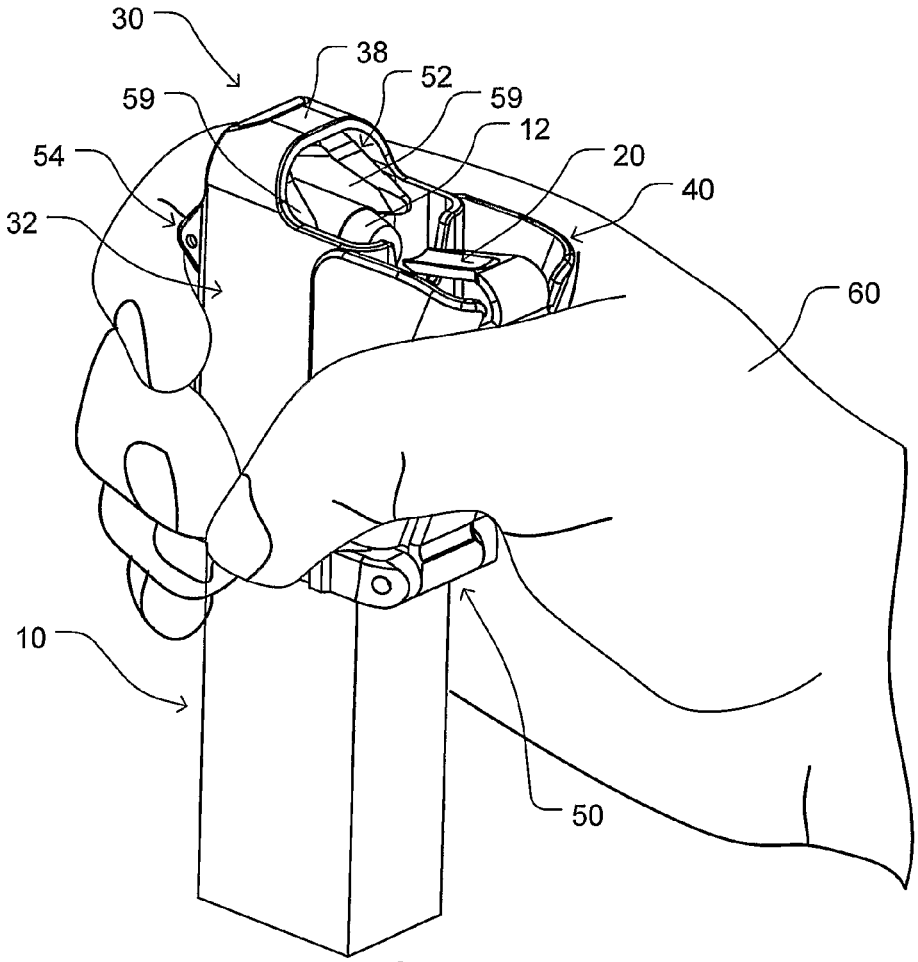
FIG. 4A is a perspective view of the loader coupled to a magazine and held by hand.
Figure 4B:
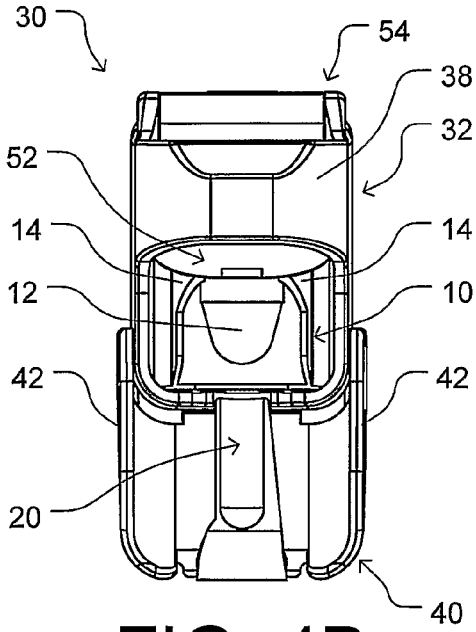
FIG. 4B is a top view of the loader shown 'away'.
Figure 4C:
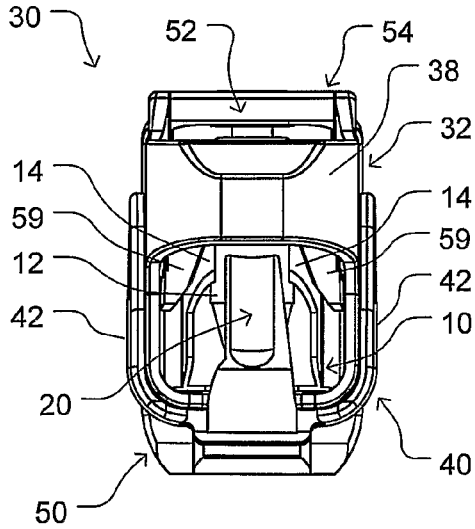
FIG. 4C is a top view of the loader shown 'close'.

FIGS. 4A-4C—Loader as Used

FIG. 4A is a perspective view of loader 30 with the plunger shown at the 'away' position in a user's hand 60 and the press not pressed. The body of the loader is inserted over or onto the top open side of magazine 10 and held substantially upright in an operating position. The bottom of the magazine is supported by a table or the like (not shown). The magazine is shown pushing aligner 52 up from below so that its wings 59 are visible and angled up. The magazine contains a topmost round 12.

FIG. 4B is a top view of the loader with the plunger in the 'away' position on top of magazine 10. Round 12 is retained between two lips 14 of the magazine. Plunger 20 is centered in the main body and press, and is directly in front of round 12 and the aligner. The plunger is further clear of the main body such that its distal front edge does not enter the internal space of the main body. Aligner 52 is shown angled down when no force is exerted from below.

FIG. 4C is a top view of the loader with the plunger shown in the 'close' position on top of the magazine. When in the 'close' position, the press fully engages the main body and the plunger is partially above the case of round 12 and between the lips of the magazine. Aligner 52 is shown angled up, revealing its wings 59.

The above description covers the loader, and the below description covers the magazine aligner.

FIGS. 5A-5J—Aligner

Figure 5A:
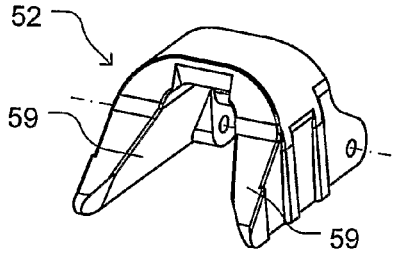
FIG. 5A is a perspective view of an aligning mechanism or 'aligner'.

FIG. 5A is a perspective view of aligner 52. The aligner resembles an inverted "V" shaped body comprising two inclined-apart spaced wings 59 coupled together at their top. The upper joined parts of the wings are closer than their distal bottom ends. The wings are flat and smooth on their inner faces and are symmetrical. At the rear of each wing is a through hole for pin 56, as mentioned above. When seen in its inverted "V" configuration (FIGS. 5B and 5E), the wings taper from wide at their tops where they are coupled together to narrow and pointed at their bottoms.

Figure 5B:
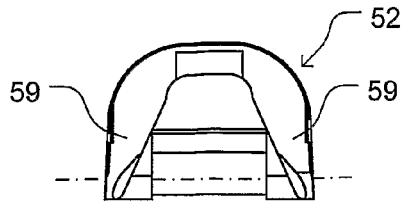
FIG. 5B to 5D are representations of the aligner, where

A front view of aligner 52 is shown in FIG. 5B. The inverted "V" shaped opening between wings 59 is clearly shown.

Figure 5D:
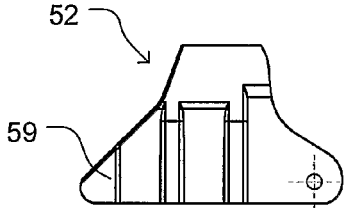
Figure 5C:
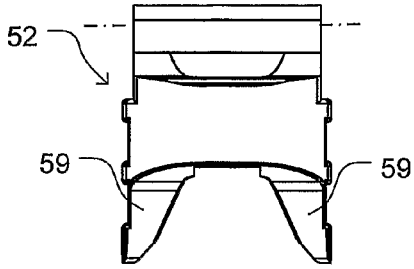

FIG. 5C shows a top view of the aligner and FIG. 5D shows a side view of the aligner with a through hole (not numbered) on the lower right. Note that when seen from the side, each wing is narrow at its top and flares out at its bottom. The bottom edges of wings 59 are horizontal.

Figure 5E:
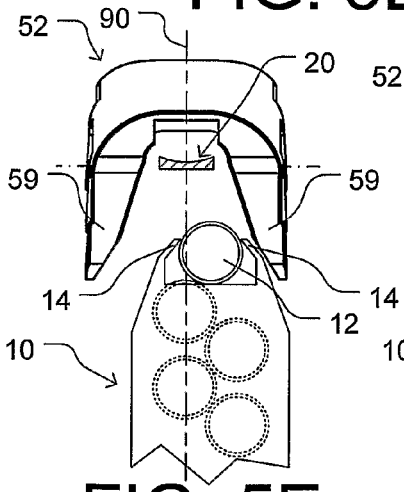
FIG. 5E is a front view of the aligner accepting an off-centered double-stack magazine.

FIG. 5E is a front view of the aligner angled down at an initial position inside the body (not shown) so to enable it to accept a magazine between its wings 59 further down in the magazine. In this example, the magazine is a double-stack magazine 10 shown before loading and off-center to the right of a center vertical line 90. Only one wing of the aligner touches the magazine in this example. Magazine 10 has lips 14 holding between them a topmost round 12. The magazine also contains few rounds (not numbered) below round 12. A sectional view of plunger 20 is shown centered between the wings of the aligner and spaced generally above topmost round 12.

Figure 5F:
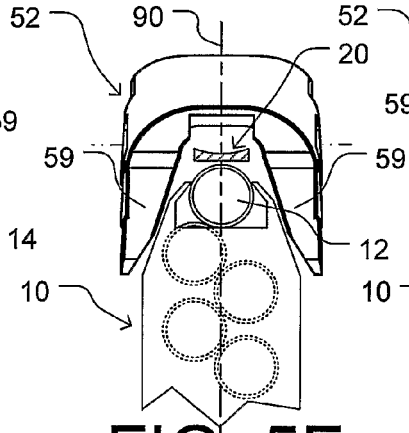
FIG. 5F is a front view of the aligner centering the double-stack magazine.

FIG. 5F is a front view of the aligner still angled down and the open top side of the magazine is now centered in the aligner, and hence centered in the body of the loader (not shown) and with respect to the plunger, along center line 90. Plunger 20 is directly above and close to topmost round 12 or contacting or resting on the topmost round.

Figure 5G:
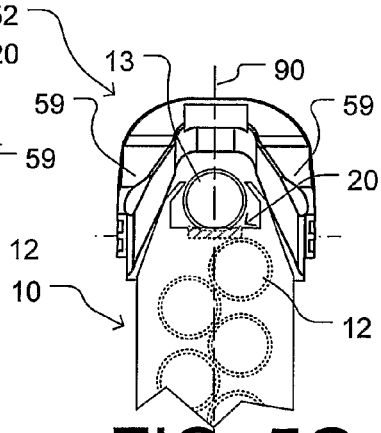
FIG. 5G is a front view of the aligner with the double-stack magazine at a loading position.

FIG. 5G is a front view of the aligner angled up as the magazine pushed it from below. The magazine is centered in the aligner and body and with respect to the plunger. The plunger forces round 12, and all other rounds, further inside the magazine. A new round 13 is shown above the plunger.

Figure 5H:
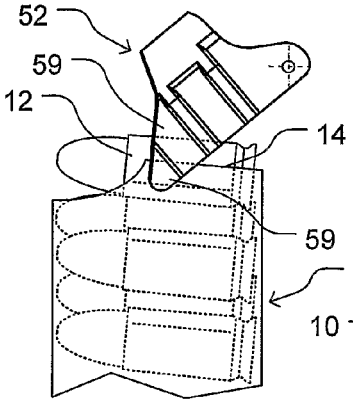
FIG. 5H is a side view of the aligner of FIG. 5E.

FIG. 5H is a side view of the aligner as shown in FIG. 5E, less the plunger, showing the aligner angled down and the magazine positioned partially between the aligner's wings. The wings of the aligner engage the magazine approximately half way across the magazine's horizontal depth.

Figure 5I:
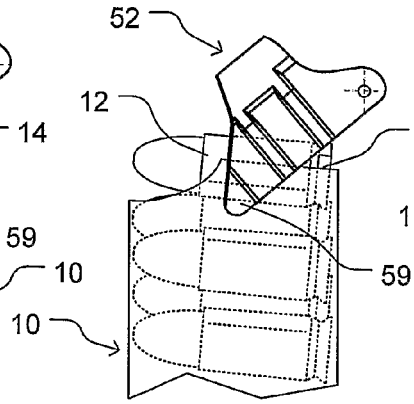
FIG. 5I is a side view of the aligner of FIG. 5F.
Figure 5J:
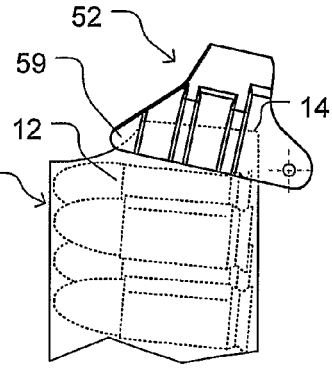
FIG. 5J is a side view of the aligner of FIG. 5G.

FIG. 5I is a side view of the aligner as shown in FIG. 5F, less the plunger, and FIG. 5J is a side view of the aligner as shown in FIG. 5G, less the plunger and round 13. The aligner is shown angled up.

Figure 6A:
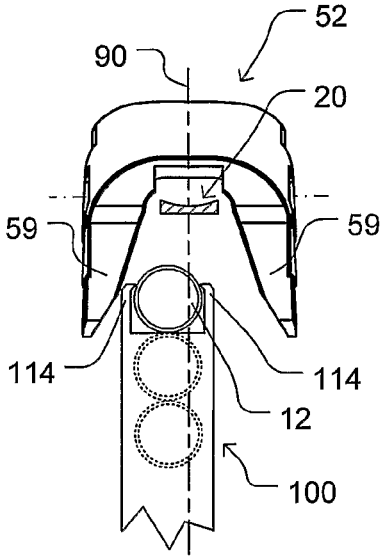
FIG. 6A is a front view of the aligner accepting an off-centered single-stack magazine.
Figure 6B:
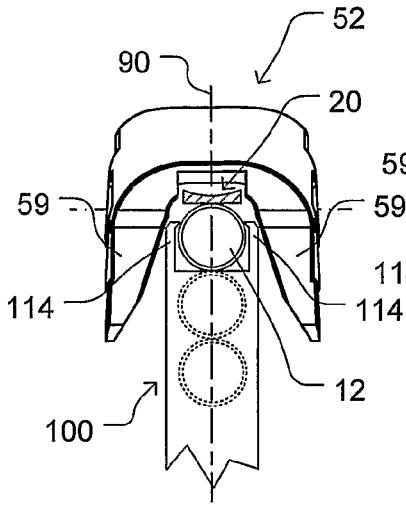
FIG. 6B is a front view of the aligner centering the single-stack magazine.
Figure 6C:
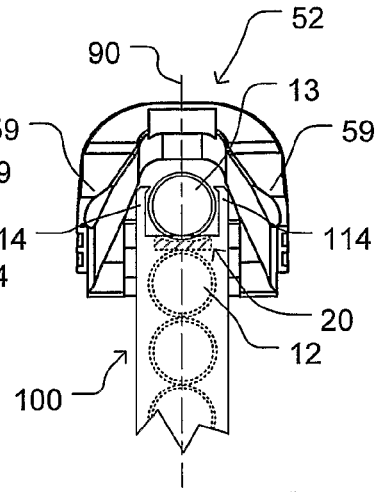
FIG. 6C is a front view of the aligner with the single-stack magazine at a loading position.

FIGS. 6A-6C—Aligner with Single-Stack Magazine

FIGS. 6A to 6C are similar to FIGS. 5E to 5G, but using a single-stack magazine 100 having lips 114. The magazine is initially left of center line 90 in this example.

The internal dimensions of main body 32, and also of any other loader part described above, preferably are designed to accept a double-stack magazine having the largest cross-sectional dimensions of any commercially available popular magazine, such as the polymer-coated magazine for the Glock .45 pistol. This design enables the loader to operate and load a wide range of thinner magazines and smaller-caliber rounds. If a loader is designed for a particular or limited number of similarly-sized magazines, the aligner may be avoided and the inner dimensions of the body should preferably match the outer dimensions of the magazines.

Operation—Preferred Embodiment—FIGS. 1A-6C

The loader provides substantial assistance to a firearm user by safely, comfortably, and rapidly loading a magazine without finger pain or injury. Using its aligning mechanism, the loader automatically adapts to fit on single and double-stack magazines with any matching rounds from preferably .380 up to .45 caliber, making it a substantially universal pistol magazine loader. The range of magazines and rounds loaded may be extended or altered, under the same loading method, by changing the dimensions of the loader's parts. Further, the loader may be easily designed without the aligner to fit a limited range of magazines and rounds, or to fit a specific magazine and round. E.g., the loader can be designed for loading just the H&K UMP .40 or .45 caliber sub-machine gun magazines, which have a relatively large cross section, or to load .380 pistol magazines and smaller.

Loading rounds into the magazine is accomplished by operating the loader to provide sufficient vacant space below the magazine's lips for rearwardly inserting (case first) a new round into the vacant space. This is accomplished by forcing the plunger to push down the topmost round of the magazine, and hence all previously loaded rounds, sufficiently into the magazine to form the vacant space below the lips. The user then effortlessly drops a new round below the lips into the vacant space. The force on the plunger is then released to allow the magazine's spring and follower to push up all the rounds in the magazine until the new topmost round engages the lips, and the plunger is withdrawn from the magazine. The user repeats the cycles until the magazine is full.

The operation of our new loading method and mechanism will now be described in detail. Then the operation of the magazine aligner will be described.

Loader

FIGS. 1A to 1F diagrammatically illustrate the method of loading a new round into a magazine. FIGS. 2A and 2B show a preferred actual embodiment of the loader for implementing the method illustrated in FIG. 1. FIG. 4A illustrates how a user load rounds with the loader.

To discuss the operation in more detail, FIG. 2A illustrates the loader at a rest position where the plunger is in the 'away' position. To load a magazine, the user preferably first rests the bottom end of the magazine on a stable surface, such as a table, hip or knee. Then, the user picks up the loader with one hand and places, fits, attaches, mounts or couples its body on top or over the open side of the magazine as illustrated in FIG. 4A, such that the bullet of an inserted round will point forward towards the user. The loader is positioned on and moved down on the magazine sufficient for the plunger to later move above the top end of the magazine without being blocked by the magazine or rounds, if loaded.

Then, in accordance with the loading method and cycle described for FIG. 1, and preferably starting from the 'away' position (FIG. 1A), the user squeezes or moves press 40 in to bring the plunger to a 'close' position above the topmost round of the magazine (FIG. 1B and FIG. 4C), or above the magazine's follower if the magazine is empty. The distal free end of the plunger is then above the case of the round, or contacting or resting on it (FIG. 1B).

Then the user holds the loader harder and pushes the loader or its body slidably down on the magazine so as to force the plunger and the top round, and all rounds below, if any, or the follower, further down into the magazine, against the magazine's spring pressure, creating a vacant space below the lips and above the plunger (FIG. 1C). The loader can go down until the underside of the plunger meets the top front edge (not numbered) of the magazine's front wall (FIGS. 1C and 1D) as usually required when loading .45 caliber rounds for creating large vacant space, or less down for smaller caliber rounds.

While keeping the loader forced down on the magazine, the user inserts a new round rearwardly on top of the plunger and into the vacant space below the lips (FIG. 1D) with the other hand.

The user then eases the downward force on the loader so that the spring of the magazine will push up all the rounds in the magazine, and hence the plunger and therefore loader, until the newly-loaded topmost round reaches the underside of the lips of the magazine and is secured by them (FIG. 1E). Roughly simultaneously while easing the downwards force on the loader, the user reduces the hand squeeze or pressure from the press to allow the press and therefore plunger to retract back, by the force of spring 48, from below topmost round 13 so that the plunger exits the magazine (FIG. 1F). Hence, a new round has been loaded.

Allowing the newly-loaded topmost round to reach the lips being forced from within the magazine keeps this round in place rather than be somewhat pulled away from the magazine by the retracting plunger. Alternatively, the plunger may be released or retracted by the press from below topmost round 13 after inserting a new round in the magazine, even if the downward force on the loader has not been released or eased by the user. Simultaneous ease and release action is preferred, however.

This loading cycle is repeated until the magazine is full. Practically, it takes approximately a second to load a single round in the magazine.

Hence, in a timely manner, while the loader is mounted on the magazine, the user manipulates the press to move it and the plunger between two basic positions: an 'away' position where the plunger is relatively distant or farther from a topmost round in the magazine or the open side of the magazine, and a 'close' position where the plunger is relatively closer or above a topmost round in the magazine or the open side of the magazine.

The loading action can also start from a 'close' plunger position where the user presses the press before or during mounting the loader on the magazine; the same principles of operation apply in this case.

Stated differently, the user loads an empty magazine with the loader in the following steps:

1. With the magazine on a table or the like, use one hand (e.g., the right hand) to fit the loader over and onto the magazine.
2. Using the right hand, squeeze the press in to cause the plunger to move in and lie over the follower. Hold the press in this position.
3. Still using the right hand and arm, and while holding the press in, force the loader down onto the magazine so that the magazine moves further into the loader and the plunger forces the follower down to create a space above the follower. Hold the loader in this down position.
4. While holding the loader down, use the left hand to insert a first round, case end first, into the space in the magazine above the follower and plunger.
5. Ease the force on the loader and the grip on the press so that the follower pushes the loader back up and pushes the first round against the lips at the top of the magazine and the plunger moves out. (Do not release the loader completely.)
6. Repeat Step 2 to cause the plunger to move in again and lie over the inserted first round.
7. Repeat Step 3 to force the first round down to create a space above the first round.
8. Repeat Step 4 to insert a second round above the first round.
9. Repeat Step 5 so that the follower pushes the first and second rounds up against the lips.
10. Repeat Steps 2 to 5 until the magazine is filled.

The above steps can be performed in a continuously cyclic manner, easily, quickly, and safely, without any strain to the fingers, hand, or arm.

After many tests the inventors found that the preferred angle $\alpha$ of the plunger is between 28 to 38 degrees down from a horizontal line. This allows the plunger to create sufficient space between the lips (FIGS. 1C and 1D) for loading both large caliber rounds (e.g., .45 caliber) down to smaller caliber rounds (e.g., .380 caliber). The larger the angle, the larger the vacant space and therefore caliber which can be inserted into that space. Further, this range of angles still allows the plunger to retract back efficiently from between the two topmost rounds (12 and 13) as shown in FIG. 1E. Thus, rounds of a wide caliber range may be loaded with a single loader and plunger.

The flat plunger preferably has a concave recess 22 on its upper surface to guide new rounds in and to allow the plunger to be extracted more smoothly from between the two topmost rounds when the rounds are forced up by the spring of the magazine against the lips.

It is a major advantage of the disclosed method and loader that pressing down the loader to press the topmost round, and all rounds below it, against the spring of the magazine can be done substantially with the full strength of a user's arm muscles, rather than with the weaker strength of the distal ends of the thumb or fingers, as done with most prior-art loaders. Thus less pain and fatigue is experienced and accumulated by the user.

Aligner

Explanation of the aligner's operation now follows. Aligner 52 is used in pistol magazine loader 30 or the alternative loaders described below. However, the aligner may be used, with or without some modifications, with other loaders, such as those sold under the trademarks HKS, Cambi, ADCO, Glock, H&K, SIG, Wilson Combat, and others.

Since pistol magazines come in varying dimensions and calibers, a magazine aligner 52 was designed to enable a single pistol magazine loader to fit as many magazines and round calibers as possible. The aligner centers mainly the open side of the magazine in the loader, rather than the bottom or base of the magazine, so that the plunger is centered above the topmost round in the magazine. If not centered, or without an aligner, a thin magazine may wiggle freely in the loader and the plunger may miss the topmost round to engage a lip of the magazine, or just miss the magazine altogether. The length of the magazine is of no importance to the operation of the aligner (or loader); only the width and depth of the magazine are relevant.

In its initial position, the aligner is preferably angled less of 45 degrees down in the loader, as best shown in FIG. 5H, being pre-pressured at its rear (not shown) by an arm of spring 58. When loading a magazine, the user mounts the loader on, say, a preloaded off-center double-stack magazine 10 as shown in FIG. 5E. The off-centered open side of the magazine reaches the inner smooth surface of, say, right wing 59 of the aligner as shown. The user then continues to force the loader down on the magazine, aiming to load a new round in, thereby causing the magazine to slide up against the inwardly-inclined internal surface of the right wing until the opposite side of the magazine reaches the other wing of the aligner, as shown in FIG. 5F. The magazine is now centered in the aligner and the loader, along center line 90. When the loader is pushed further down, the spring-loaded aligner will start to angle up, still keeping the magazine centered, as plunger 20 engages the case of topmost round 12. The aligner keeps the open side of the magazine centered all along the downward distance of the loader as the plunger forces down the topmost round further into the magazine. The aligner is designed and arranged to align and center the magazine preferably before the topmost round in the magazine reaches the plunger. Once a new round is loaded, raising back up the loader to start a new loading cycle causes the aligner to angle back down by spring 58 to its initial position.

Thus, the aligner is tilted up for every round-loading cycle in the magazine. The same aligning action is done with thinner magazines, i.e. as the single-stack magazine shown in FIGS. 6A to 6C. Further, because the aligner is hinged at its rear, as it is angled up by the magazine from below, the resistance of the inner surface of the two wings of the aligner to the side walls of the magazine cause the magazine to also move forward towards the front wall of the body and towards the plunger. This aids magazines of shorter depth to be loaded as well, as they are brought close to the plunger. Further, the force of the angled plunger on the topmost round also moves the entire magazine forward towards the press. While the magazine is centered at its upper open side in the aligner, it may be off-centered at its bottom without interfering much with the loading process.

Hence, the aligner allows loading magazines of different width and depths in a single magazine loader, eliminating the need to manufacture spacers or loaders of various dimensions for various magazines.

ALTERNATIVE EMBODIMENTS

Several alternative embodiments of the loader and its parts will now be discussed.

Figure 7A:
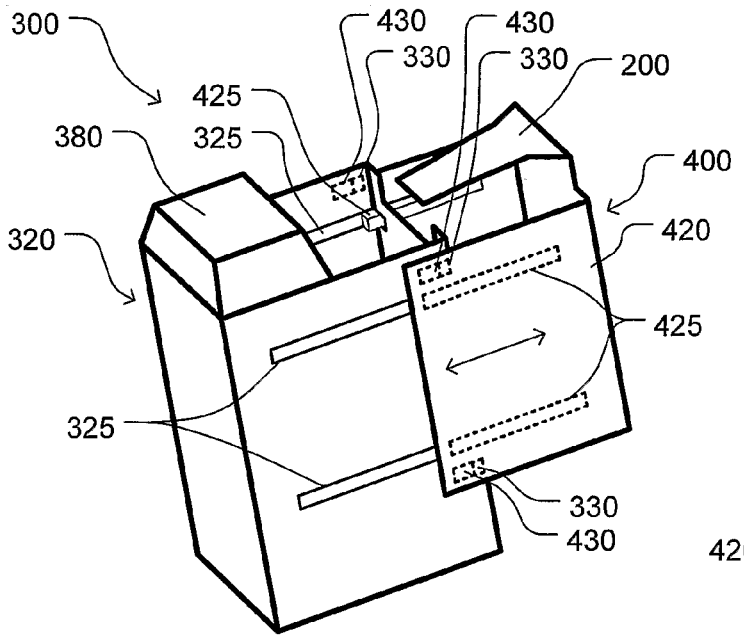
FIG. 7A is a simplified perspective view of a first alternative body and press.
Figure 7B:
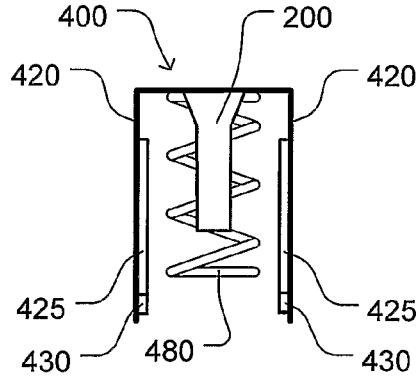
FIG. 7B is a simplified top view of the first alternative press.

Description—FIGS. 7A-7B

FIG. 7A is a simplified perspective view of a first alternative loader 300 having the same basic construction of loader 30 of FIG. 2, but with a first alternative body 320, a first alternative press 400, and a bridge 380. Press 400 includes plunger 200, angled down $\alpha$ degrees and similar or identical to plunger 20 described above. The plunger is shown at an 'away' position, clear of a magazine if inserted (not shown). The press is slidable on mating elongated male and female rails 425 and 325, respectively. Any other mating sliding construction can be used on sidewall 420 of the press and body 320 for doing the same. The press includes a break or stop 430 adapted to engage a protruding break 330 of the body to prevent the press from dropping off the body. Loader 300 may or may not include aligner 52 (not shown) with a similar construction.

FIG. 7B is a simplified top view of press 400 showing male rail 425 and break 430 on the inner side of each sidewall 420, and a compression spring 480 fitted between the press and the body, below plunger 200. Spring 480 replaces spring 48 of previous construction to urge and push back the press when the hand grip is released.

Operation—FIGS. 7A-7B

Loader 300 operates much the same as loader 30, but using a press which moves in and out parallel with the body. When press 400 is pressed towards the body (not shown), the plunger moves to a 'close' position above a topmost round or the follower in the magazine, if installed. Then the loader is forced down so that plunger 200 forces down any existing rounds and or the follower and a new round is loaded, as described above for loader 30. The plunger moves to the 'away' position by spring 480 force when the press is released. Aligner 52 inside the body, if installed, operates the same as explained above.

Figure 7C:
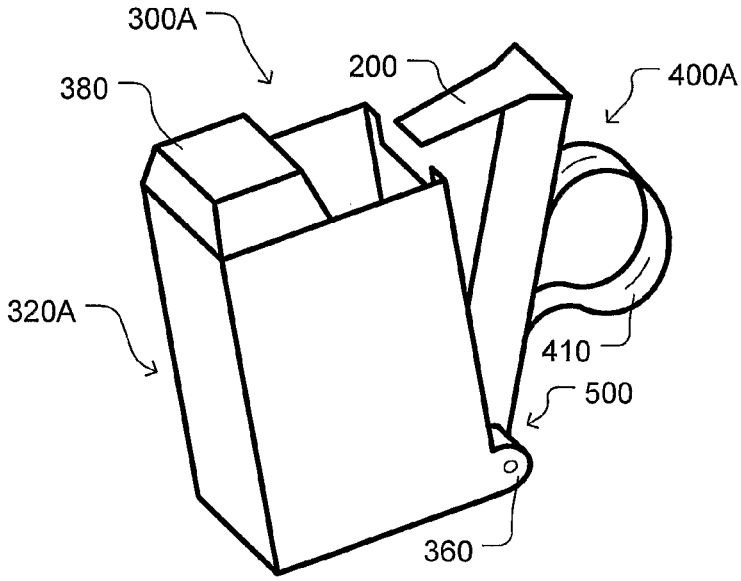
FIG. 7C is a simplified perspective view of a second alternative body and press.

Description—FIG. 7C

FIG. 7C is a simplified perspective view of a second alternative loader 300A having the same basic construction of loader 30 but with a second alternative body 320A and a second alternative press 400A. Press 400A is shown at an 'away' position, clear of an inserted magazine (not shown). This loader does not have a torsion spring 48 (or 480), previously described, between the body and the press; rather press 400A includes an ear or ring 410 sized to fit at least a finger inside so to allow the press and plunger to be moved to the 'away' position, or to the 'close' position, with a finger rather than with the spring. Press 400A is hinged to the body with hinge 500, being much the same as hinge 50 described above, using a alternative press arm 360. Alternative loader 300A has plunger 200 similar or identical to plunger 20 described above.

Operation—FIG. 7C

Loader 300A operates much the same as loader 30, but it uses press 400A which is adapted to retract back to an 'away' position using at least one finger in ring 410 rather than using an urging spring. The loader is forced down so that plunger 200 forces down any existing rounds and or the follower, and a new round is loaded, as described above for loader 30 and 300. The user pulls back the press by the finger after each round is loaded. Eliminating the spring reduces parts count.

Description—FIGS. 8A-8D

Figure 8A:
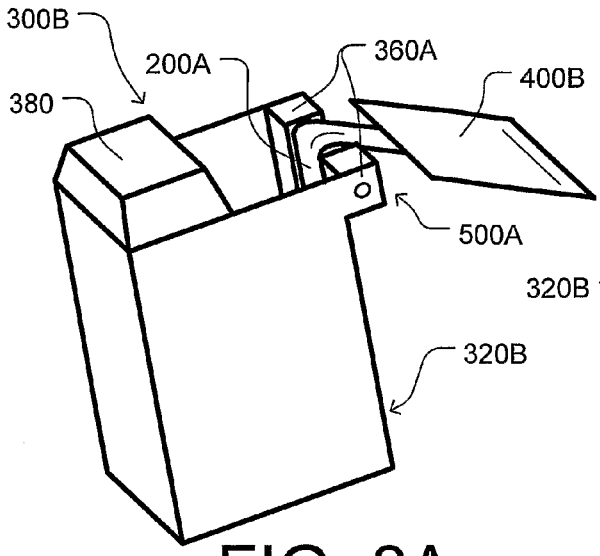
FIG. 8A is a simplified perspective view of a third alternative body and press.

FIG. 8A is a simplified perspective view of a third alternative loader 300B according to the invention. It comprises a third alternative body 320B and a press 400B. A second alternative press hinge 500A, which includes a second alternative press arms 360A, is located at the top or upper part of the body, rather than at the bottom part, as are press hinges 50 and 500 of previous embodiments. Press 400B includes an alternative press retainer 460 (FIG. 8D) at its top with a through hole (not numbered), being part of hinge 500A, for coupling the press to the body with a pin (not shown), as previously described. Press 400B includes a pressing area (not numbered) sized and arranged for pressing it by hand, and includes plunger 200A, which is similar or identical to previous plungers. In FIG. 8A the press is shown raised up and the plunger is shown pointing down inside the body along its side wall at a first 'away' position, clear of a topmost round or the open side of a magazine if inserted (not shown). A vertical recess exists (not shown) at the inner side of the front wall of the body sized to accept the plunger when it is down so it will not interrupt or block a magazine in the loader.

Figure 8B:
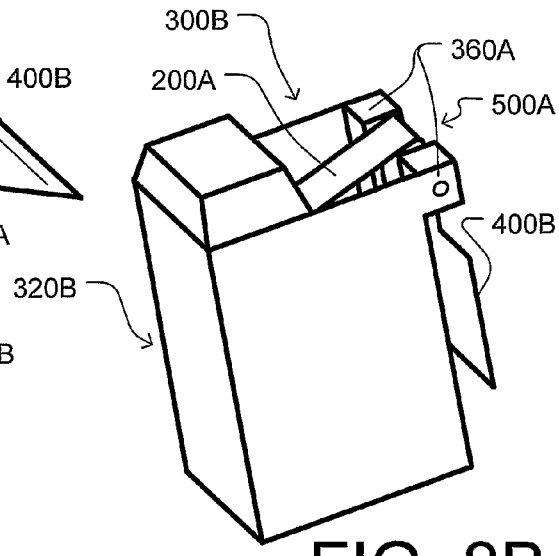
FIG. 8B is another simplified perspective view of the third alternative body and press.

FIG. 8B is a simplified perspective view of loader 300B where press 400B is shown down adjacent body 320B and plunger 200A is therefore raised up inside the body to be in the 'close' position. In this position the plunger is above a topmost round in the magazine, if installed, and is angled preferably $\alpha$ degree down from the horizontal (for loading preferably .380 to .45 caliber rounds), as previously described.

Figure 8C:
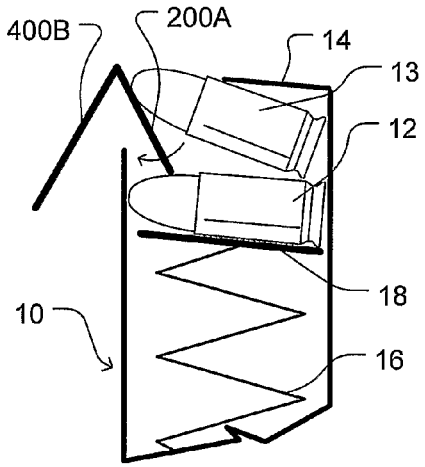
FIG. 8C is a simplified drawing showing retracting of the plunger of the third alternative press.

FIG. 8C shows a simplified side cut-view portion of plunger 200A and magazine 10 inserted in loader 300B (not shown). The plunger is shown retracting out or withdrawing from beneath a new rearwardly loaded round 13 in a substantially (clockwise) curved path, in the general direction of the arrow, rather than retracting out at substantially linear straight path as shown by the arrow in FIG. 1F for loader 30.

Figure 8D:
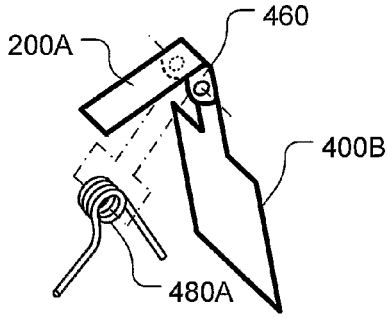
FIG. 8D is a simplified perspective view of the third alternative press, and a plunger.

FIG. 8D is a simplified perspective view of press 400B which includes alternative press retainer 460. Preferably a torsion press spring 480A is mounted in hinge 500A between press 400B and body 320B designed to urge the press to angle with respect to the body so that the plunger will be at an 'away' position as shown and described in connection with FIG. 8A. Spring 480A is preferably located between press retainers 460 and secured by pin 47 (not shown) mounting the press to the body. One arm of the spring pushes the body while the other pushes the press from below.

Operation—FIGS. 8A-8D

Loader 300B operates much the same as loader 30, but uses a press which is hinged at its top to the top of the body. Again, the press allows the plunger to be moved back and forth between its 'away' (FIG. 8A) and 'close' (FIG. 8B) positions. For loading, the user operates the loader over the open side of the magazine, squeezing the press to bring the plunger to the 'close' position, and pushing down the loader onto the magazine. This cause the plunger to push down the topmost round or follower and creates space at the top of the magazine so that a new round can be fed into the magazine. Then the force on the loader is released so that the spring of the magazine slightly lifts up all the rounds in the magazine and the loader until the topmost round engages the lips. The user releases the force on press 400B to bring the plunger to the 'away' position using the force of spring 480A on the press.

In an alternative embodiment ('A') and operation of loader 300B of FIGS. 8A-8D, spring 480A is eliminated and press 400B is made heavier than the plunger. Thus, the press will be initially held down by its weight and the plunger will therefore be initially up inside the body when vertical, as illustrated in FIG. 8B. Hence, the plunger will be at an initial 'close' position, opposite to what was described for FIGS. 1A-7C where the plungers are at an initial 'away' position prior to loading. The user will then have to move press 400B back or upward (counterclockwise) to move the plunger to the 'away' position. To load, the user places loader 300B on top of the magazine (not shown) without moving the press at all, as the press is down and the plunger is up. The user then forces the loader or body on the magazine to force down the plunger to press the rounds down deeper in the magazine. Following the insertion of a new round in the magazine, the user raises the loader and raises press 400B for the rounds to be forced up by the spring of the magazine and for moving the plunger to the 'away' position as shown in FIG. 8A.

Further, in another alternative embodiment ('B') and operation of loader 300B of FIGS. 8A-8D, press 400B is eliminated, and a reduced force spring 480A is positioned at hinge 500A so as to lift up and keep plunger 200A at the initial 'close' position, with minimal force. The plunger is coupled to and tiltable by hinge 500A. I.e., the plunger is initially up, and can be lowered down inside the body with minimal force from above against its spring. One arm of spring 480A is positioned at the under-side of the plunger to raise it up and the second arm is positioned on the inner upper side of the front wall of the body. Press 400B is eliminated by, say, simply cutting it off at its top just before hinge 500A or press retainer 460 (FIG. 8D); press retainer 460 remains and keeps plunger 200A coupled by hinge 500A to the body.

To load, the user just places the loader on top of the magazine, force down the loader so that the raised plunger 200A presses the topmost round down further into the magazine to provide sufficient vacant space, and inserts a new round rearwardly in the vacant space, as explained previously. Then, without doing any other action, the user lifts or raises the loader up along the magazine sufficient for the plunger to angle down (FIG. 8C) in a clockwise direction, against the low spring 480A force. The plunger angles down by the force of the newly-loaded topmost round 13 pressing on it from above as the loader is raised by the user along and on the magazine, while the magazine remains on the solid surface. The plunger will then eventually be momentarily at the 'away' position and will flip or move back up by spring 480A to the 'close' position once clear from and above round 13. Hence, a new round was loaded and a new loading cycle can begin.

Still further, in another alternative embodiment ('C') and operation of loader 300B of FIGS. 8A-8D, press 400B is eliminated as described immediately above in the alternative embodiment 'B', and spring 480A is also eliminated so that the plunger is free to tilt around hinge 500A. Plunger 200A will then be able to move to the 'close' position if the loader is tilted sufficiently from the vertical in a direction for it to move or tilt by gravity towards the 'close' position. Once tilted towards the 'close' position, the plunger will be contacted or pushed from its under-side by the topmost round to reach the 'close' position when the loader is forced on the magazine to start a new loading cycle. The plunger will then force down the topmost round for creating a vacant space below the lips for inserting a new round in. Then the user will raise the loader sufficient to free the plunger from between the two topmost rounds by (clockwise) rotation (FIG. 8C) bringing it to the 'away' position, and will tilt the loader once more so that the plunger will tilt from the 'away' position towards the 'close' position as described for starting another loading cycle.

Aligner 52, or any other aligner, inside the body, if installed, operates the same as explained previously. This press and plunger configuration can also be modified and altered in many ways under the principles described here.

Figure 8E:
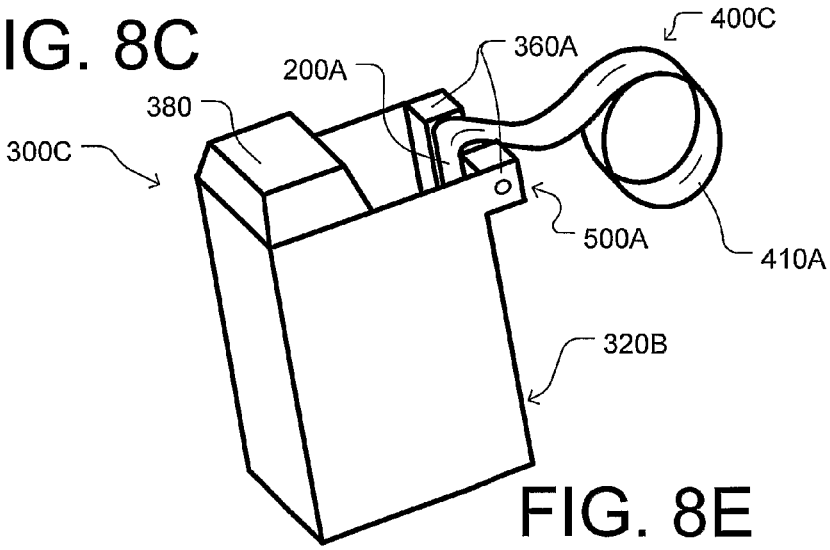
FIG. 8E is a simplified perspective view of a forth alternative press.

Description—FIG. 8E

FIG. 8E is a simplified perspective view of a forth alternative loader 300C comprising body 320B and a forth alternative press 400C. It is built much the same as loader 300B with plunger 200A, but here press 400C includes an alternative ring 410A, similar to ring 410 of FIG. 7C, and no urging spring (480A) between the press and the body. Ring 410A is sized to accept at least one finger of the user (not shown).

Operation—FIG. 8E

Loader 300C operates much the same as loader 300B of FIGS. 8A-8D, but uses a press that can be retracted back to an 'away' position using at least one finger rather than using an urging spring, as press 400A of FIG. 7C. Further, the user can also move the press and plunger from the 'away' position to the 'close' position using a finger. Eliminating the spring reduces parts count. This configuration can also be modified and altered in many ways, under the principles described previously.

Figure 9A:
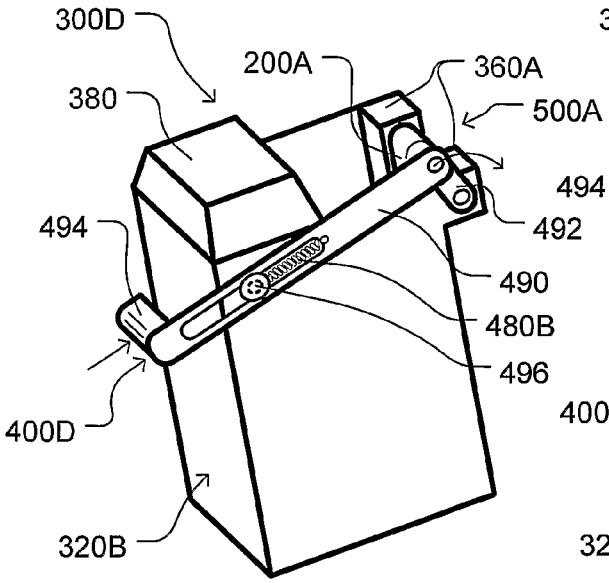
FIG. 9A is a simplified perspective view of a fifth alternative press.
Figure 9B:
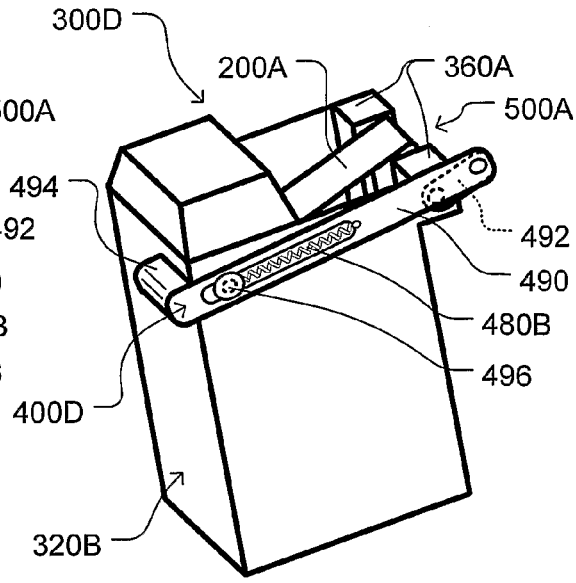
FIG. 9B is another simplified perspective view of the fifth alternative press.

Description—FIGS. 9A-9B

FIG. 9A is a simplified perspective view of a fifth alternative loader 300D comprising body 320B and a fifth alternative press 400D. It is built much the same as loader 300B of FIGS. 8A-8D with hinge 500A and plunger 200A, shown at the 'away' position. However here press 400D is activated from the rear wall (not numbered) of the body, rather than from the front wall of the body (not numbered) as illustrated this far. Press 400D comprises a force transport mechanism built of an elongated arm 490 hingely coupled to a rotating shorter arm 492 which is rigidly coupled to plunger 200A through press arm 360A with an internal pin or bar (not numbered). This articulated arm configuration also acts as a lever. Arm 490 has an opening (not numbered) along a portion of its length in through which a headed pin 496 is permanently secured to body 320B, and an extension spring 480B is connected between pin 496 and the right side of the opening. At the left end of arm 490 is a boss 494 or handle designed to be pushed by at least one finger. Alternatively, spring 480B may be replaced by a torsion spring (not shown) at hinge 500A of the body as discussed above.

FIG. 9B shows press 400D moved to raise the plunger to the 'close' position inside the body. Spring 480B is shown stretched by the force acting on the press.

Operation—FIGS. 9A-9B

Loader 300D operates much the same as loader 300B of FIGS. 8A-8D and the other loaders described, but now the user presses or squeezes boss 494 towards the body with one or more fingers to raise the plunger to the 'close' position. Arm 490 transports the force from the finger, stretching spring 480B, to cause arm 492 to turn clockwise, as shown by the curved arrow in FIG. 9A, hence raising the plunger to the 'close' position. The loader is then forced down on the magazine to create a vacant space for loading a new round. Spring 480B pulls back arm 490 and hence the plunger to the 'away' position when the boss is released and the loader is raised. This press configuration can also operate without spring 480B if the finger pulls back the boss if replaced by a ring. This force transport configuration can also be modified and altered in many ways, under the principles described here.

Figure 9C:
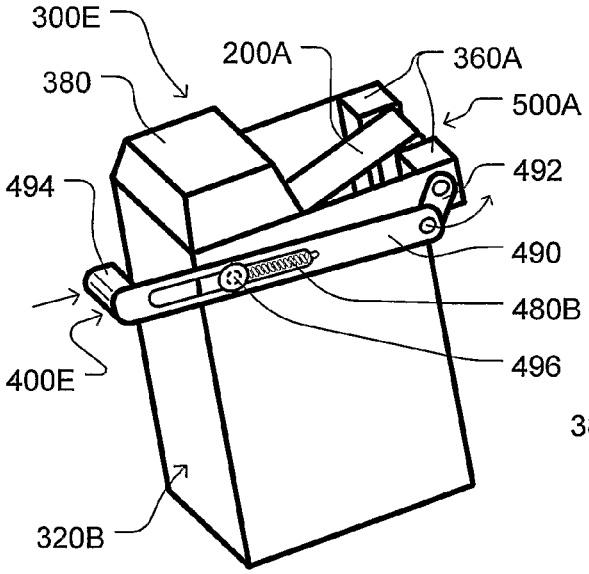
FIG. 9C is a simplified perspective view of a sixth alternative press.

Description—FIG. 9C

FIG. 9C is a simplified perspective view of a sixth alternative loader 300E, but where the plunger is initially at the 'close' position. It comprises a body 320B, a sixth alternative press 400E, plunger 200A, hinge 500A, and is built very similar to loader 300D of FIGS. 9A-9B. Again, the press is activated from the rear wall (not numbered) of the body as with press 400D, and comprises the force transport mechanism of press 400D. Press 400E comprises an elongated arm 490 hinged to a rotating shorter arm 492 which is rigidly coupled to plunger 200A through press arm 360A with an internal pin or bar (not numbered). This configuration also acts as a lever. Press 400E is very similar to press 400D of loader 300D but here the plunger is made to be at the initial or first 'close' position raised up inside the hollow body (as described above for the alternative embodiment of FIGS. 8A-D when spring 480A is absent). I.e., an inverse or opposite connection or coupling of arm 490 to plunger 200A exists such that the direction of the plunger movement is opposite that of loader 300D of FIG. 9A. This is achieved by changing the angles of connection between arm 490, arm 492, and the plunger as shown.

Operation—FIG. 9C

Loader 300E is similar in operation to loader 300D of FIGS. 9A-9B. However here the user presses or squeezes boss 494 towards the body with one or more fingers to lower the plunger to the 'away' position, not shown, rather than raising the plunger to the 'close' position when activating the press. To load a new round in a magazine, the loader with its plunger at the initial 'close' position is placed on the magazine (not shown) and forced down on it (without activating the press) to create a vacant space for loading a new round. A new round is then inserted in the vacant space. The user then eases the downward force on the loader so that the spring of the magazine raises all the rounds up as explained before, and while doing so, the user presses boss 494 with a finger so to move the plunger from its 'close' position to the 'away' position (not shown) to release the plunger from between the two topmost rounds and the magazine. Arm 490 transports the force from the finger, stretching spring 480B, to cause arm 492 to turn counterclockwise, as shown by the curved arrow, hence lowering the plunger. Spring 480B pulls back arm 490 and hence the plunger to the 'close' position when the boss is released. This press configuration can also operate without spring 480B if the finger pulls back the boss if replaced by a ring. This force transport configuration can also be modified and altered in many ways, under the principles described.

Figure 9D:
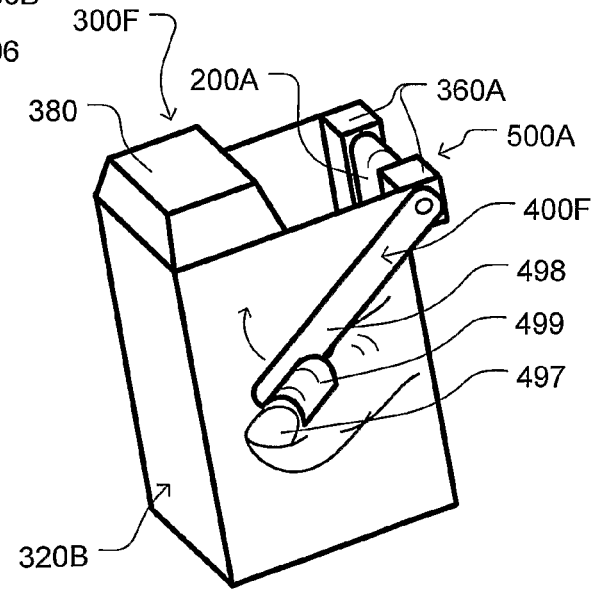
FIG. 9D is a simplified perspective view of a seventh alternative press.

Description—FIG. 9D

FIG. 9D is a simplified perspective view of a seventh alternative loader 300F comprising body 320B and a seventh alternative press 400F. It is built much the same as loader 300B to 300E with plungers 200A and hinge 500A, but here press 400F is activated from a side wall (not numbered) of the body rather than from the front or back wall of the body (not numbered) as described above. Press 400F comprises an elongated lever 498, parallel with the body's side wall, which is rigidly coupled to plunger 200A through press arm 360A with an internal pin or bar (not numbered). This configuration also acts as a lever. Lever 498 has a ring or upper thumb cover 499 at its distal left end where a thumb 497 is shown.

Operation—FIG. 9D

Loader 300F operates much the same as the other loaders described, but now the user lifts thumb 497 while holding the loader over the magazine (not shown) to raise lever 498 and hence the plunger to move the plunger from an 'away' position to a 'close' position. Once the plunger touches and rests on the topmost round, the user may lower the thumb and grasp the body firmly to forced down the loader on the magazine to create a vacant space for loading a new round. The weight of the press, lever 498, and cover 499 may cause the plunger to angle down naturally to its 'away' position, so that a pull-back spring (not shown) is not necessary, but recommended. A circular thumb ring may replace cover 499 so the user can easily move the lever up and down. This lever configuration can also be modified and altered in many ways, under the principles described previously.

A stop or limit, not shown, as a pin or a bar or in hinge 500A, is incorporated in loaders 300B to 300F of FIGS. 8A-9D to limit the angle of the plunger to the α angle (FIG. 1B) when in the 'close' position and to counter resist the force from the magazine's spring when loading.

Figure 10A:
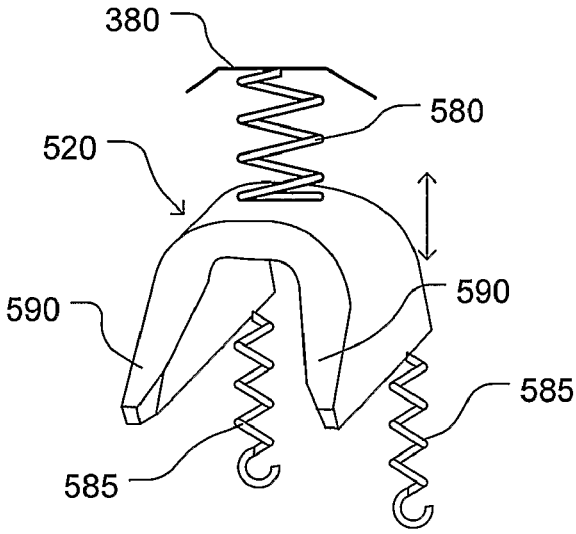
FIG. 10A is a simplified perspective view of a first alternative aligner.

Description—FIG. 10A

FIG. 10A is a simplified perspective view of a first alternative aligner 520 having two wings 590 with the same basic construction as aligner 52 described above for FIG. 5. Aligner 520 is positioned below bridge 380 (or 38) and is made to move only up and down in the main body on rails or limiters (not shown). In one instance, a compression spring 580 is positioned between aligner 520 and bridge 380. Spring 580 has the same function as aligner spring 58 previously described. At another instance, aligner 520 may have one or more extension springs 585 connected to its bottom on one side and to the main body of the loader on the other side, for exerting a downwards force on the aligner in a manner similar to the described above.

Operation—FIG. 10A

Aligner 520 is built and works much the same as aligner 52 but now in is movable in a linear path up and down as shown by the double-headed arrow. Compression spring 580 keeps the aligner pressured on the magazine to have the magazine align itself centrally between wings 590. Aligner 520 will move up when aligning a magazine and back down when the loader is lifted up. The same operation applies when using spring 585 instead of spring 580.

Figure 10B:
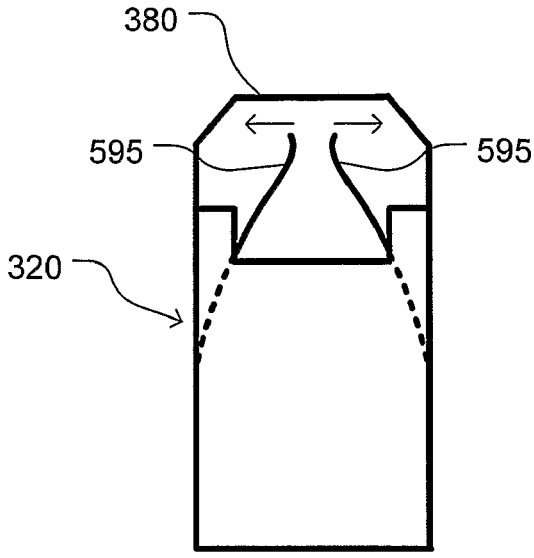
FIG. 10B is a simplified front view of a second alternative aligner.

Description—FIG. 10B

FIG. 10B is a simplified front view of a second alternative aligner 595 constructed internally and symmetrically between to opposite sidewalls of body 320, or any other body, below bridge 380 (or 38). Aligner 595 is a minimal aligner comprises two smooth flat leaf spring members or wings (here shown only the side view) attached to the lower internal part of the body and extend and come closer symmetrically upwards within. Alternatively, aligner 595 may be attached oppositely below the bridge and extend symmetrically downwards (not shown) for doing the same.

Operation—FIG. 10B

Aligner 595 has similar aligning function as aligner 52 of FIG. 5. Springy wings 595 force an off-center magazine inserted from below to be centered at its top inside the body. Each wing will move outwardly, in the direction of the arrow drawn, until the pressure on both wings is equal, therefore aligning the magazine in the body.

CONCLUSION, RAMIFICATIONS, AND SCOPE

The reader will see that we have provided an efficient, pocket-size, comfortable, and safe magazine loader comprising few parts that can load single and double-stacked magazines, and rounds of different calibers. This is done without any adjustments, inserts, or modification to the loader.

While the above description contains many specificities, these should not be construed as limitation on the scope, but rather as an exemplification of one preferred embodiment.

All numerical values provided are approximate, and are variable to adapt to other magazines or round types and or sizes. The following are further examples of some but not all variations and ramifications:

The loader described is constructed to fit and operate with most pistol, handgun, and some submachine-gun magazines available in the market. It can be altered to fit other magazines and calibers provided a suitable change in dimensions is made in the loader.

The loader, as well as its components, may be made of separate or different plastic materials, or, alternatively, of other materials, such as aluminum or steel, or any combination thereof.

Various other spring types or other mechanical means or methods may replace either of the two torsion springs mentioned. Such can be a double torsion-spring, a flat steel spring, a flexible rubber, or a flexible polymer spring member.

The loader may also be constructed without the aligner, or may include insertable spacer(s) to cater for magazines of different dimensions. Such may be the case with a loader for specific magazines or unique magazines where an aligner is not requested or needed.

Although it was described that an angle of α degrees down from the horizontal is suitable for loading rounds ranging preferably from .380 up to .45 caliber, different plunger angles may be chosen. A loader for a specific magazine, or a limited-range of magazines or calibers, may have a different angle or range of angles. This mainly depends on the caliber and height of the front wall of the magazine—to allow the plunger to provide sufficient vacant space and to retract back easily.

Plunger 20 may include ribs in its construction to strengthen it so it will not break or dent under pressure by the spring of the magazine. It may also be of uniform thickness, and also be thinner if stronger material is chosen. It may also be flexible under certain circumstances.

The loader can be held in the hand and operated opposite to the manner illustrated in FIG. 4A, i.e., the fingers may clutch the press instead of the body of the loader. The same operation applies as previously described.

Many types of presses can be designed for the loader for moving the plunger between its two main positions—'away' and 'close' position, or vise-versa. Only few types were described above. They would all share the basic method of loading and moving the plunger here described and would be constructed similar to what we have described in this document.

Hinge 50, 500 or 500A or similar may be positioned elsewhere on the body and press. For example, the hinge may be positioned anywhere between the locations of the current hinges, e.g., midway between the bottom and the top of the front wall of the body, and accordingly changed in the press.

The body of the loader may be split into two or more parts, connected or not, or may have openings to reduce weight or add functionality.

A lock mechanism may be included in the loader to lock and keep the press closed so to reduce its size for transport and storage. Such lock was not included in the drawings.

The plunger can also be used for assisting unloading of rounds from the magazine—under certain operational sequence.

The described loader can be thoroughly amended to load also rifle and submachine gun magazines.

A detachable or fixed container may be added to the loader or a similar loader for holding loose rounds which are automatically fed to the loading device as the press is operated.

A different aligner may be built under the same method described above where a magazine is automatically centered and aligned in a loader, inline with the plunger of the loader. As an example, the aligner may be built using only a single metal wire formed in the general contour and dimensions of aligner 52.

Many other types of stop or break mechanisms numbered 34 and 44 may be built for limiting the movement of the press.

An industrial machine using the methods and plunger described here may be designed for mass loading rounds into pistol magazines. This machine may be used in military armories, shooting ranges, and in production plants.

An electromechanical device, as an electric motor, solenoid, and a power source (batteries or AC line), and a controller or switch, may be included in a modified loader, or with the above described machine to automate the loading operation.

Accordingly, the scope of the invention should be determined, not by the embodiments illustrated, but by the appended claims and their legal equivalents.

The invention claimed is:

1. An accessory for facilitating the loading of rounds into a firearm magazine having an open top side with lips and which holds one or more columns of rounds therein and urges said rounds to and feeds said rounds from said open top side of said magazine, comprising:

a hollow body shaped and sized to fit over said open top side of said magazine, said hollow body having an open bottom that can accept said magazine when said top side of said magazine is inserted into said open bottom, said hollow body having a plurality of sides extending up from said open bottom, a press coupled to one of said sides of said body so that said press can be moved between first and second positions, said first position being relatively distant from said one side of said body and said second position being relatively close to said one side of said body, a plunger coupled to said press, said plunger projecting from said press and having a free end, said press and said plunger being arranged and positioned so that (a) when said press is in said first position, said plunger is substantially clear from over said open top side of said magazine so that said magazine can urge any round or rounds in said magazine to said open top side, (b) when said press is moved from said first to said second position, said plunger will move to over said open top side of said magazine so that when said hollow body is pushed down on said magazine said free end of said plunger will push down any round or rounds in said magazine so to create a vacant space at said open top side of said magazine below said lips of said magazine and above said plunger, (c) when said press is moved from said second to said first position, said plunger will move away so as to be clear from said open top side of said magazine, whereby when said hollow body is fitted over said magazine, said press can be moved between said first and second positions, such that in said first position, said plunger will be away from said open top side of said magazine, and in said second position said plunger will be over said open top side of said magazine and said hollow body can be pushed further onto said magazine to push a topmost round in said magazine away from said open top side of said magazine to facilitate loading of a new round into said vacant space above said plunger, where said new round is in the magazine above said plunger and below said lips of said magazine, and when said press is moved to said first position said plunger is extracted from below said new round, and any round in said magazine is urged against said open top side of said magazine, thereby facilitating loading of rounds into said magazine easily and painlessly.

2. The accessory of claim 1, further including a spring member arranged to urge said press to said first position.

3. The accessory of claim 1 wherein said press has a pair of sidewalls extending toward said body and external thereto so as to enclose the space between said body and said press.

4. The accessory of claim 1 wherein said hollow body has two opposite sides with tops and a bridge extending between and joining said tops.

5. The accessory of claim 1 wherein said plunger is substantially flat and rigid.

6. The accessory of claim 1 wherein said plunger has a proximal end attached to said press and opposite said free end being distal from said press, said plunger being angled down such that said distal free end is lower than said proximal end when said press is in said second position and said body is vertically positioned.

7. The accessory of claim 6 wherein said plunger angles down substantially 28 to 38 degrees from the horizontal when said press is in said second position and said hollow body is vertically positioned.

8. The accessory of claim 1, further including an aligner operatively coupled to said hollow body for centering or aligning said open top side of said magazine with respect to said plunger when said body is on said magazine and said magazine is narrower than said hollow body.

9. The accessory of claim 8 wherein said aligner comprises an inverted V-shaped member having tapering legs with tops, said legs being joined at said tops, said legs tapering so that their bottoms are narrower than said tops when said aligner is seen in an inverted-V configuration.

10. The accessory of claim 8 wherein said aligner further includes a spring member coupled to said body and arranged to urge said aligner onto said open top side of said magazine.

11. The accessory of claim 1 wherein said press is coupled to said body by hinge means for pivotally coupling said press to said body, said hinge means positioned at a bottom of said press and at a bottom of said body.

12. The accessory of claim 1 wherein said press is arranged to move in and out parallel to said body between said second and said first positions, respectively.

13. The accessory of claim 1 wherein said press has an operating ring so that said press can be moved manually between said second and said first positions.

14. The accessory of claim 1 wherein said press is coupled to said body by hinge means for pivotally coupling said press to said body, said hinge means positioned at a top of said press and at a top of said body.

15. The accessory of claim 14 wherein said press has a pressing area with a size sufficient for moving said press manually between said first and said second positions.

16. The accessory of claim 14 wherein said press comprises a force transport mechanism adapted to allow said press to move between said first and said second positions.

17. The accessory of claim 14 wherein said press comprises a lever mechanism adapted to allow said press to move between said first and said second positions.

18. A method of loading a firearm magazine having a spring and a follower and an open side with lips and arranged to hold a plurality of rounds, where said spring and follower urges said rounds to said open side, comprising:

providing a housing fittable over said open side of said magazine, said housing including a press and a plunger coupled to said press, said plunger having a free distal end, said plunger being moveable by said press between two positions: an away position where said plunger is not over said follower or any rounds above said follower, and a close position where said plunger is over said follower or any rounds above said follower, positioning said housing over said open side of said magazine with said plunger in said away position, moving said press so that said plunger moves to said close position over said follower or any rounds above said follower, forcing said housing further onto said magazine so that said free distal end of said plunger pushes said follower or any round or rounds above said follower away from said open side and thereby creates a vacant space at said open side of said magazine below said lips and above said plunger, inserting a new round into said vacant space in said magazine, reducing said force on said housing and said press so as to allow said spring to urge said new round and any rounds below said new round against said lips of said magazine and so that said plunger will move to said plunger's away position not over said follower or any rounds above said follower, whereby by sequentially operating said press so that said plunger moves from said plunger's away to said plunger's close position, forcing said housing further onto said magazine, and inserting a new round into said vacant space, and releasing said force from said housing and moving said press to said plunger's away position, said magazine may be easily loaded with new rounds without having to use one's finger to directly push down any preloaded rounds, thereby preventing finger fatigue and injury.

19. The method of claim 18 wherein said plunger is substantially flat and rigid.

20. The method of claim 18, further providing spring means arranged to urge said press and plunger to said plunger's away position.

21. The method of claim 18, further providing aligning means for aligning said open side of said magazine with respect to said plunger when said housing is positioned over said magazine.

22. The method of claim 18 wherein said press is coupled to said body by hinge means arranged to pivotally couple said press to said body, said hinge means positioned at a bottom of said press and at a bottom of said body.

23. The method of claim 18 wherein said press is coupled to said body by hinge means arranged to pivotally couple said press to said body, said hinge means positioned at a top of said press and at a top of said body.

24. A loading or inserting device for facilitating loading items into a magazine that is arranged to hold an individual item or plurality of individual items, said magazine comprising a container having a bottom, an enclosing side wall extending up from said bottom, and a top opposite said bottom, said top being at least partially open, and said magazine being arranged to urge said individual item or said plurality of items toward said top and receive and dispense said items individually at said top, said loader or inserting device comprising:

pushing means, a projecting member, and body means to hold, said body means mountable over said top of said magazine and arranged to hold said pushing means, said pushing means coupled to said projecting member, said pushing means being moveable to a first position for causing said projecting member to be positioned over said top of said magazine for contacting or resting above said individual item or said plurality of individual items, said body means being movable down onto said magazine when said pushing means is in said first position so that said projecting member will urge said individual item or said plurality of individual items to be moved away from said top of said magazine so as to create a space adjacent said top of said magazine for enabling an additional item to be inserted into said magazine, said body means also being movable up and said pushing means also being moveable to a second position for causing said projecting member to be withdrawn from said top of said magazine and to allow said magazine to urge said additional item and said individual item or said plurality of individual items, against said partially open top of said magazine.

25. The loading or inserting device of claim 24 wherein said items are ammunition rounds and said magazine is a firearm magazine, said pushing means is a press, and said projecting member is a plunger.

26. The loading or inserting device of claim 24, further including an aligner operatively coupled to said body for centering or aligning said top of said magazine with respect to said body means and said projecting member when said body is mounted over said magazine.

27. The loading or inserting device of claim 26 wherein said aligner comprises an inverted V-shaped member having tapering legs with tops, said legs being joined at said tops, said legs tapering so that their bottoms are narrower than said tops when said aligner is seen in an inverted-V configuration.

28. The loading or inserting device of claim 26 wherein said aligner further includes a spring member coupled to said body and arranged to urge said aligner onto said open top of said magazine.

29. An accessory for facilitating the loading of rounds into a firearm magazine having an open side and which holds one or more columns of rounds therein and urges said rounds to and feeds said rounds from said open side of said magazine, comprising:

a hollow body shaped and sized to fit over said open side of said magazine, a press coupled to said body so that said press can be moved between first and second positions, a plunger coupled to said press, said plunger projecting from said press and having a free end, said press being positioned so that (a) when said press is in said first position, said plunger will extend over said open side of said magazine so that when said hollow body is pushed down on said magazine, said plunger will push down any round or rounds in said magazine, (b) when said press is moved from said first to said second position, said plunger will move substantially clear from over said open side of said magazine so that said magazine can urge any round or rounds in said magazine to said open side, (c) when said press is moved from said second to said first position, said plunger will move substantially over said open side of said magazine, whereby when said hollow body is fitted over said magazine, said hollow body can be pushed further onto said magazine to push a topmost round in said magazine away from said open side of said magazine to form a vacant space adjacent said open side of said magazine to facilitate loading of a new round into said vacant space, said press can be moved between said first and second positions, such that in said second position, said plunger will be substantially clear from over said open side of said magazine, and when said plunger is substantially clear from over said open side of said magazine, any round in plunger will be substantially clear from over said open side of said magazine, and when said plunger is substantially clear from over said open side of said magazine, any round in said magazine can be urged against said open side of said magazine, thereby facilitating loading of rounds into said magazine easily and painlessly.

30. The accessory of claim 29, further including a spring member arranged to urge said press to move to said first position.

31. The accessory of claim 29, further including an aligner operatively coupled to said body for centering or aligning said open side of said magazine with respect to said body and said plunger when said body is mounted over said magazine.

32. The accessory of claim 31 wherein said aligner comprises an inverted V-shaped member having tapering legs with tops, said legs being joined at said tops, said legs tapering so that their bottoms are narrower than said tops when said aligner is seen in an inverted-V configuration.

33. The accessory of claim 31 wherein said aligner further includes a spring member coupled to said body and arranged to urge said aligner onto said open top of said magazine.

34. An accessory for facilitating the loading of rounds into a firearm magazine having an open side and which holds one or more columns of rounds therein and urges said rounds to and feeds said rounds from said open side of said magazine, comprising:

a hollow body shaped and sized to fit over said open side of said magazine, a plunger coupled to said body by hinge means so that said plunger can moved between a first or initial position and a second position, said plunger having a free distal end, said plunger being movable so that (b) when said hollow body is raised up, said plunger will move to said second position substantially clear from over said open side of said magazine so that said magazine can urge any round or rounds in said magazine to said open side, whereby when said hollow body is fitted over said magazine, said hollow body is pushed further onto said magazine to push a topmost round in said magazine away from said open side of said magazine to form a vacant space adjacent said open side of said magazine to facilitate loading of a new round into said vacant space, and when said hollow body is raised up said plunger will move from said first to said second position, such that in said second position said plunger will be substantially clear from over said open side of said magazine, and when said plunger is substantially clear from over said open side of said magazine, all said rounds in said magazine are urged against said open side of said magazine, thereby facilitating loading of rounds into said magazine easily and painlessly.

35. The accessory of claim 34, further including a spring member arranged to urge said plunger to move to said first position.

36. The accessory of claim 34, further including an aligner operatively coupled to said body for centering or aligning said open side of said magazine with respect to said body and said plunger when said body is mounted on said magazine.

37. The accessory of claim 36 wherein said aligner comprises an inverted V-shaped member having tapering legs with tops, said legs being joined at said tops, said legs tapering so that their bottoms are narrower than said tops when said aligner is seen in an inverted-V configuration.

38. The accessory of claim 36 wherein said aligner further includes a spring member coupled to said body and arranged to urge said aligner onto said open side of said magazine.

* * * * *